US008613449B2

(12) United States Patent
Brodrick

(10) Patent No.: US 8,613,449 B2
(45) Date of Patent: Dec. 24, 2013

(54) RESOLVING WAGERS BASED ON OUTCOMES OF DICE GAMES

(75) Inventor: David Brodrick, Plano, TX (US)

(73) Assignee: David Brodrick Enterprises, LLC, Plano, TX (US)

( * ) Notice: Subject to any disclaimer, the term of this patent is extended or adjusted under 35 U.S.C. 154(b) by 113 days.

(21) Appl. No.: 13/013,678

(22) Filed: Jan. 25, 2011

(65) Prior Publication Data

US 2011/0278794 A1 Nov. 17, 2011

Related U.S. Application Data

(60) Provisional application No. 61/333,997, filed on May 12, 2010.

(51) Int. Cl.
*A63F 3/08* (2006.01)

(52) U.S. Cl.
USPC ..... 273/274

(58) Field of Classification Search
USPC ..... 273/274
See application file for complete search history.

(56) References Cited

U.S. PATENT DOCUMENTS 5,350,175 A 9/1994 DiLullo et al.
5,413,351 A 5/1995 Franklin
5,487,547 A * 1/1996 Hobert ..... 273/274
5,490,670 A * 2/1996 Hobert ..... 463/20
5,728,002 A * 3/1998 Hobert ..... 463/17
5,732,948 A * 3/1998 Yoseloff ..... 273/274
5,785,596 A * 7/1998 Hobert ..... 463/22
5,806,847 A * 9/1998 White et al. ..... 273/309
5,809,749 A * 9/1998 Ruggiero et al. ..... 53/473
5,829,748 A * 11/1998 Moore, Jr. ..... 273/274
5,964,463 A * 10/1999 Moore, Jr. ..... 273/274
6,336,633 B1 1/2002 Webb
6,364,314 B1 * 4/2002 Canterbury ..... 273/274
6,464,225 B1 10/2002 Webb
6,601,848 B1 * 8/2003 Timmons, Sr. ..... 273/146
6,926,607 B2 * 8/2005 Slomiany et al. ..... 463/20
7,255,350 B2 * 8/2007 Timmons, Sr. ..... 273/274
7,568,697 B2 * 8/2009 Silverman ..... 273/146
7,811,165 B2 * 10/2010 Slomiany et al. ..... 463/16
7,819,402 B2 * 10/2010 Witz ..... 273/146
7,976,372 B2 * 7/2011 Baerlocher et al. ..... 463/12
8,221,214 B2 * 7/2012 Nicely ..... 463/20
8,231,458 B2 * 7/2012 Baerlocher et al. ..... 463/25
8,235,812 B2 * 8/2012 Baerlocher et al. ..... 463/30
8,241,104 B2 * 8/2012 Wolf ..... 463/20
8,246,446 B2 * 8/2012 Wollner ..... 463/22
2001/0022430 A1 9/2001 Promutico
2002/0066998 A1 6/2002 Stern (Continued)

*Primary Examiner* — Kurt Fernstrom
*Assistant Examiner* — Dolores Collins
(74) *Attorney, Agent, or Firm* — Fish & Richardson P.C.

(57) ABSTRACT

In some implementations, a multiplayer game includes a playing surface including a plurality of areas. Each area is assigned to a number, associated with a probability of rolling the assigned number using one or more multi-faced die, and assigned odds paid for wagering on the one or more multi-faced dice rolling on the assigned number for a single roll. The one or more multi-faced dice are configured to generate at least one random number. A plurality of lines separates the plurality of areas on the playing surface. Each line separates two different numbers with some pairs of numbers having different rolling probabilities and some pairs having the same probability, is associated with a probability of rolling one of the two different numbers, and is assigned odds paid for wagering on the one or more multi-faced die rolling on one of the two different numbers.

14 Claims, 13 Drawing Sheets

(56) References Cited

U.S. PATENT DOCUMENTS

| | | | | |
|---|---|---|---|---|
| 2006/0290056 | A1* | 12/2006 | Stasi | 273/274 |
| 2009/0146372 | A1* | 6/2009 | Witz | 273/146 |
| 2009/0179377 | A1* | 7/2009 | Stasi | 273/274 |
| 2010/0171267 | A1* | 7/2010 | Walker | 273/274 |
| 2010/0187758 | A1* | 7/2010 | Abrahamson | 273/274 |
| 2010/0201070 | A1* | 8/2010 | Ramsey | 273/274 |

* cited by examiner

700

FIG. 7a

| CATEGORY | BET | ODDS PAID | HOUSE EDGE |
|---|---|---|---|
| FIELD BETS | 7 | 9 TO 2 | 8.33% |
| | 2 OR 12 | 34 TO 1 | 2.78% |
| | 6 OR 8 | 6 TO 1 | 2.78% |
| | 3 OR 11 | 16 TO 1 | 5.56% |
| | 5 OR 9 | 15 TO 2 | 5.56% |
| | 4 OR 10 | 10 TO 1 | 8.33% |
| RANGE BETS | 3, 4, 5, 6 | 3 TO 2 | 2.78% |
| | 8, 9, 10, 11 | 3 TO 2 | 2.78% |
| INSIDE LINE BETS - ALL PAY 4 TO 1 | | | 2.78% |
| HARD WAY BETS - ALL PAY 34 TO 1 | | | 2.78% |
| HARD WAY LINE BETS - ALL PAY 16 TO 1 | | | 5.56% |
| TRIPLE SEVENS BONUS BET - PAYS 200 TO 1 | | | 6.94% |
| TOTAL | | | 4.36% |

FIG. 7b1

720

| A. CATEGORY OF BETTING AREA | B. BETTING AREA | I. OCCURRENCES BASED ON STANDARD ODDS OF A PAIR OF SIX-SIDED DICE | C. PAYOUT PROPOSED PAYOUT AGAINST A SINGLE WAGER | D. ACTUAL MATHEMATICAL ODDS | E. ODDS PAID DETERMINED BASED ON COLUMN C. PAYOUT ADJUSTED TO SIMPLE MATHEMATICAL TERMS FOR EASE OF ADMINISTERING THE GAME | F. HOUSE EDGE CALCULATED FROM THE DIFFERENCE BETWEEN THE HOUSE EARNINGS AND HOUSE PAYOUT (COLUMN G - COLUMN H) |
|---|---|---|---|---|---|---|
| OVERALL | TOTAL NUMBER OF BETS 43 | | | | | 4.30% |
| FIELD | 2 | 1 | 34 | 35 TO 1 | 34 TO 1 | 2.78% |
| FIELD | 3 | 2 | 16 | 17 TO 1 | 16 TO 1 | 5.56% |
| FIELD | 4 | 3 | 10 | 11 TO 1 | 10 TO 1 | 8.33% |
| FIELD | 5 | 4 | 7.5 | 8 TO 1 | 15 TO 2 | 5.56% |
| FIELD | 6 | 5 | 6 | 6.2 TO 1 | 6 TO 1 | 2.78% |
| FIELD | 7 | 6 | 4.5 | 5 TO 1 | 9 TO 2 | 8.33% |
| FIELD | 8 | 5 | 6 | 6.2 TO 1 | 6 TO 1 | 2.78% |
| FIELD | 9 | 4 | 7.5 | 8 TO 1 | 15 TO 2 | 5.56% |
| FIELD | 10 | 3 | 10 | 11 TO 1 | 10 TO 1 | 8.33% |
| FIELD | 11 | 2 | 16 | 17 TO 1 | 16 TO 1 | 5.56% |

TO FIG. 7b2

FIG. 7b2

FROM FIG. 7b1

720

| | | | | | | |
|---|---|---|---|---|---|---|
| FIELD | 12 | 1 | 34 | 35 TO 1 | 34 TO 1 | 2.78% |
| LINE | 2 OR 6 | 6 | 5 | 5 TO 1 | 5 TO 1 | 0.00% |
| LINE | 3 OR 5 | 6 | 5 | 5 TO 1 | 5 TO 1 | 0.00% |
| LINE | 8 OR 12 | 6 | 5 | 5 TO 1 | 5 TO 1 | 0.00% |
| LINE | 9 OR 11 | 6 | 5 | 5 TO 1 | 5 TO 1 | 0.00% |
| LINE | 7 AND 2 | 7 | 4 | 4.14 TO 1 | 4 TO 1 | 2.78% |
| LINE | 7 AND 12 | 7 | 4 | 4.14 TO 1 | 4 TO 1 | 2.78% |
| LINE | 6 AND 3 | 7 | 4 | 4.14 TO 1 | 4 TO 1 | 2.78% |
| LINE | 8 AND 11 | 7 | 4 | 4.14 TO 1 | 4 TO 1 | 2.78% |
| LINE | 5 AND 4 | 7 | 4 | 4.14 TO 1 | 4 TO 1 | 2.78% |
| LINE | 9 AND 10 | 7 | 4 | 4.14 TO 1 | 4 TO 1 | 2.78% |
| DIAGONAL LINE | 4 AND 10 | 6 | 4.5 | 5 TO 1 | 9 TO 2 | 8.33% |
| DIAGONAL LINE | 5 AND 9 | 8 | 3 | 3.5 TO 1 | 3 TO 1 | 11.11% |
| DIAGONAL LINE | 3 AND 11 | 4 | 7.5 | 8 TO 1 | 15 TO 2 | 5.56% |
| DIAGONAL LINE | 6 AND 8 | 10 | 2.5 | 2.6 TO 1 | 5 TO 2 | 2.78% |
| DIAGONAL LINE | 2 AND 12 | 2 | 16 | 17 TO 1 | 16 TO 1 | 5.56% |
| HARD WAY | 4 | 1 | 34 | 35 TO 1 | 34 TO 1 | 2.78% |

TO FIG. 7b3

FIG. 7b3

FROM FIG. 7b2

| | | | | | | |
|---|---|---|---|---|---|---|
| HARD WAY | 6 | 1 | 34 | 35 TO 1 | 34 TO 1 | 2.78% |
| HARD WAY | 8 | 1 | 34 | 35 TO 1 | 34 TO 1 | 2.78% |
| HARD WAY | 10 | 1 | 34 | 35 TO 1 | 34 TO 1 | 2.78% |
| HARD WAY LINE BET | 2 OR 4 | 2 | 16 | 17 TO 1 | 16 TO 1 | 5.56% |
| HARD WAY LINE BET | 4 OR 6 | 2 | 16 | 17 TO 1 | 16 TO 1 | 5.56% |
| HARD WAY LINE BET | 6 OR 8 | 2 | 16 | 17 TO 1 | 16 TO 1 | 5.56% |
| HARD WAY LINE BET | 8 OR 10 | 2 | 16 | 17 TO 1 | 16 TO 1 | 5.56% |
| HARD WAY LINE BET | 10 OR 12 | 2 | 16 | 17 TO 1 | 16 TO 1 | 5.56% |
| RANGE | LOW (3-6) | 14 | 1.5 | 1.57 TO 1 | 3 TO 2 | 2.78% |
| RANGE | HIGH (8-11) | 14 | 1.5 | 1.57 TO 1 | 3 TO 2 | 2.78% |
| BLOCK | 4, 5, 9, 10 | 14 | 1.5 | 1.57 TO 1 | 3 TO 2 | 2.78% |
| BLOCK | 3, 6, 8, 11 | 14 | 1.5 | 1.57 TO 1 | 3 TO 2 | 2.78% |
| BLOCK | 2, 7, 12 | 8 | 3 | 3.5 TO 1 | 3 TO 1 | 11.11% |
| TRIPLE 7'S | 3RD ROLL | 216 | 200 | 215 TO 1 | 200 TO 1 | 6.94% |
| OUTSIDE | PAIR | 6 | 4.5 | 5 TO 1 | 9 TO 2 | 8.33% |
| OUTSIDE | EVEN | 18 | 1 | 1 TO 1 | 1 TO 1 | 0.00% |
| OUTSIDE | ODD | 18 | 1 | 1 TO 1 | 1 TO 1 | 0.00% |

720

RESOLVING WAGERS BASED ON OUTCOMES OF DICE GAMES

CLAIM OF PRIORITY

This application claims priority under 35 U.S.C. §119 to U.S. Provisional Application No. 61/333,997, filed on May 12, 2010, the entire disclosure of which is incorporated herein by reference.

TECHNICAL FIELD

This invention relates to games and, more particularly, to resolving wagers based on outcomes of dice games.

BACKGROUND

Games involving gambling on dice, typically referred to as craps, have been played for most of the last 100 years. The game enjoyed great popularity with the troops during World War II. The banked version of craps, as played in casinos, was very popular in the years immediately following the war. Basically, the banked version of craps involves rolling two dice on a typical "tub table," which is a table with vertical walls and an upright wooden raft running around its outside edge. The table is generally attended by dealers and boxmen, one of whom may be known as a "stickman." The table surface is generally covered with cloth printed with designs enabling the placing of bets by the shooter and players. The dice are thrown after the person throwing the dice, the "shooter," makes a bet that he or she will pass or win. Other players may place bets, as well. Generally, the shooter and players win immediately if a 7 or 11 is rolled on the first roll, and lose immediately if a 2, 3, or 12 is rolled. If any other total (4, 5, 6, 8, 9 or 10) is rolled, that total becomes the shooter's "point" and he or she continues rolling until winning by rolling the point again, or losing by rolling a seven. Players do not gamble against each other; rather, all bets are made against the house. Chips or other markers are generally used to indicate the placing of a wager on a board indicating the various betting options and odds.

SUMMARY

The present disclosure is directed to resolving wagers based on outcomes of dice games. In some implementations, a game includes a playing surface including a plurality of areas. Each area is assigned to a number, associated with a probability of rolling the assigned number using one or more multi-faced die, and assigned odds paid for wagering on the one or more multi-faced dice rolling on the assigned number for a single roll. The one or more multi-faced die are configured to generate at least one random number. A plurality of lines separates the plurality of areas on the playing surface. Each line separates two different numbers with different rolling probabilities, is associated with a probability of rolling one of the two different numbers, and is assigned odds paid for wagering on the one or more multi-faced die rolling on one of the two different numbers. Markers represent various monetary values for wagering by players participating in the game.

The details of one or more embodiments of the invention are set forth in the accompanying drawings and the description below. Other features, objects, and advantages of the invention will be apparent from the description and drawings, and from the claims.

DESCRIPTION OF DRAWINGS

FIGS. 7A and 7B illustrate example charts identifying odds paid for a multi-player game;

Like reference symbols in the various drawings indicate like elements.

DETAILED DESCRIPTION

Figure 1:
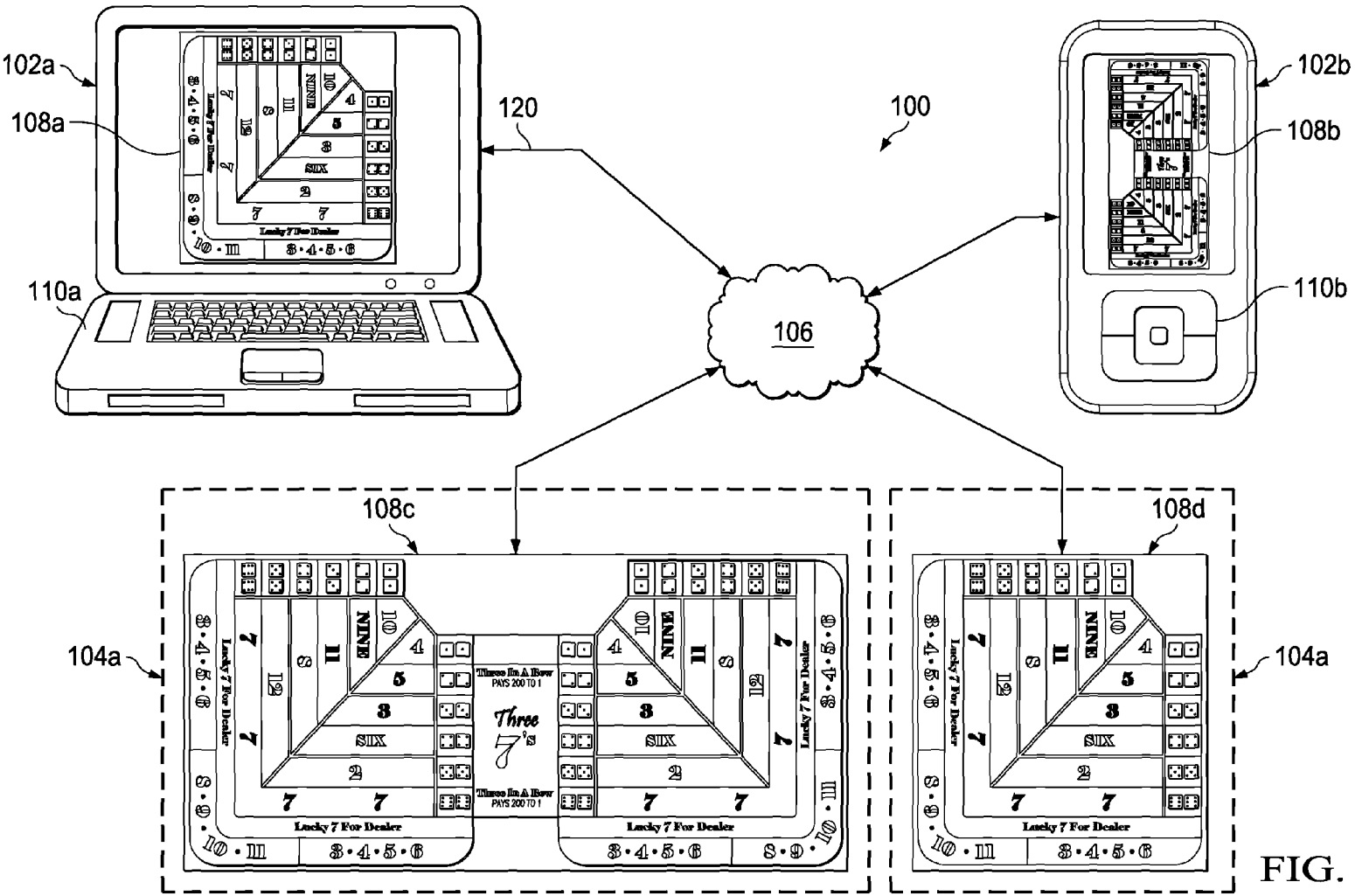
FIG. 1 is an example gaming system in accordance with some implementations of the present disclosure.

FIG. 1 illustrates a gaming system 100 for wagering markers in accordance with some implementations of the present disclosure. For example, the system 100 may determine a single payout for a single roll of six-sided dice. In some implementations, the system 100 may include bets on a single roll of multi-faced dice, multiple rolls of multi-faced dice, or both. In regards to bets based on a single roll, the system 100 may include bets for at least a subset of the possible combinations rolled by multi-faced dice during a single roll. For example, the system 100 may include bets for all numbers that a six-sided dice may roll. In addition to field bets, the system 100 may include bets on lines between two numbers, pairs, line between pairs, ranges (e.g., odd numbers, even numbers, number sequences), and/or others. Line bets may allow players to bet on two numbers with different probabilities and/or numbers with same probabilities. For example, the system 100 may include a line that is adjacent an area assigned to a bet with the greatest probability (e.g., 7) and an area assigned to a bet with the lowest probability (e.g., 2). In this instance, a player may place a bet that the dice will generate a number assigned to the highest-probability area or the lowest-probability area. In regards to bets based on multiple rolls, the system 100 may include bets on numbers or other combinations that occur during different rolls. For example, the system 100 may include bets on a specific number (e.g., seven) occurring during a specified number of consecutive rolls (e.g., three). In some implementations, the system 100 may include a single bet based on multiple dice rolls as compared with other dice-based games that include multiple bets based on multiple rolls. By simplifying the dice game to these types of bets and/or limiting bets based on multiple rolls, the system 100 may provide one or more of the following advantages: encourage a broader audience of players due to a simplified playing rule; increase the number of betting decisions per hour; substantially prevent long-term playing strategy by having a single payout for a single roll; and/or others.

In general, the system 100 may be played in a wagering and/or a non-wagering setting. For example, the system 100 may exchange tokens, chips or markers that represent a particular monetary value, and, in the case of a wagering setting, players may exchange money for the markers. Regardless, the winning or losing bets are determined by the random number generator such as rolling the dice, executing software, operating an electronic device, and/or other methods. The system 100 may include odds paid that are different from actual odds. In this case, an enterprise managing the system 100 may set the odds paid as lower than the actual odds to provide an edge for the enterprise or house. In some implementations, the system 100 can have a single payout for a single roll to ensure no correlation between rolls. In other words, limiting play to a single roll may ensure that each roll is an independent event.

Turning to the illustrated implementation, the system 100 includes user devices 102*a* and 102*b* and enterprises 104*a* and 104*b* couple through network 106. The user devices 102 are electronic devices that are owned, operated or otherwise associated with a user and operable to at least receive access to services from the network 106. In addition, the user devices 102 include a Graphical User Interface (GUI) 110 that presents a gaming surface 108. The enterprises 104*a* and 104*b* are brick-and-mortar organizations that own, operate or otherwise manage dice-based games including games using the gaming surface 108. In some implementations, the gaming surface 108 may include bets based on a single roll or multiple rolls of multi-faced dice. In connection with multi-roll bets, the system 100 may divert or otherwise add a portion of losing wagers to a pot. In these instances, the size of the pot may increase over a given period of time. In some implementations, the pots may be combined from different games such that winning the bet on one of the playing surfaces 108 results in winning the pots from each of the gaming surfaces 108 or splitting these pots with other winners. The network 106 may facilitate communication between the different gaming surfaces 108 including identifying a status and associated pot amount. At a high level of operation, the user devices 102 and/or the enterprises 104 may receive bets on the gaming surface 108. In response to a user rolling multi-faced dice, the user devices 102 and/or the enterprises 104 may pay out bets based on the rolled combination. In some implementations, the user devices 102 and/or the enterprises 104 may identify line bets between numbers with different odds. For example, the user device 102 may identify a line bet on a number with the second highest probability and the second lowest probability of being rolled.

The gaming surface 108 may be a physical, a virtual, or a combination of the foregoing area configured to receive bets from different players. For example, the gaming surface 108*a* may be a virtual surface presented through the GUI 110*a* of the user device 102*a*. In some implementations, the gaming surface 108 may include a physical surface that has a smaller footprint than other dice games such as craps. For example, the gaming surface 108 may include a playing area of about 8 feet (ft.) by 4 ft. as compared with the 12 or 14 ft. tables for craps. In doing so, the gaming surface 108 may provide more playing areas in a given area which may increase the number of bets placed in a given area per period of time. In addition, the gaming surface 108 may enable multiple players to participate in the game, which may increase player participation and excitement.

In some implementations, the gaming surface 108 includes a plurality of different playing areas and different playing lines with each element associated with a predefined bet. For example, each area may be assigned a possible outcome of a pair six-sided dice, and the lines may be assigned a probability of the six-sided dice rolling one of two outcomes. As previously mentioned, the different areas may be assigned to a specific number, a pair, odd numbers, even numbers, different ranges, and/or others. In regards to areas assigned to specific numbers, adjacent areas may be assigned to numbers with a high probability and areas with a low probability. For example, an initial pair of adjacent areas may be assigned to a number with the highest probability of rolling and the number with the lowest probability of rolling and a subsequent adjacent pair may be assigned to a number with the second highest probability of rolling and the number with the second lowest probability of rolling. In this example, the surface 108 may include a second subsequent pair with one area assigned to the number with the third highest probability of rolling and a second area assigned to the number with the third lowest probability of rolling. In these examples, the surface 108 may include these pairs such that the areas alternate between high and low probabilities. In some implementations, the surface 108 may include areas aligned serially and alternating between higher and lower probabilities along a single direction or a plurality of directions. By alternating between high and low probabilities, the players may be more likely to distribute bets across the playing surface 108. In addition, the arrangement of the betting areas and the line bets may normalize the probabilities. In other words, the numbers may be arranged such that the line bets each covers seven permutations.

In some implementations, the gaming surface 108 may include boundaries between areas with different probabilities such as additional areas or line segments. For example, the gaming surface 108 may include line segments between two adjacent areas. These types of line segments may identify bets that the dice will roll one of the two numbers or outcomes assigned to the adjacent area. In other words, the gaming surface 108 may include betting options that cover multiple numbers or areas. For example, the gaming surface 108 may include betting options that include two different numbers with the same probabilities (e.g., 2 and 12) or different probabilities (e.g., 2 and 7). The previously-discussed bets are based on a single roll of multi-faced dice but the gaming surface 108 may include at least one bet that is based on multiple rolls of the dice. In these implementations, the gaming surface 108 may identify an outcome for each of a plurality of different rolls of the dice. For example, the gaming surface 108 may identify a bet that the multi-faced dice will roll three consecutive sevens. The gaming surface 108 may include other bets based on consecutive rolls, predefined outcomes within a certain number of rolls, and/or other variations. In connection with multi-roll bets, the system 100 may divert or otherwise add a portion of losing wagers to a pot. In these instances, the size of the pot may increase over a given period of time. In some implementations, these areas for a plurality of different gaming surfaces 108 may be combined such that the pots for each of these areas are combined through the network 106.

User device 102 is any local or remote computing device operable to receive requests from the user via a user interface 110, such as a GUI, a CLI (Command Line Interface), or any of numerous other user interfaces. Thus, where reference is made to a particular interface, any other user interface may be substituted in its place. In various implementations, each user device 102 includes at least GUI 110 and comprises an electronic computing device operable to receive, transmit, process and store any appropriate data associated with system 100. There may be any number of user devices 102 communicably coupled to the network 106. Further, "user device 102" and "user" may be used interchangeably as appropriate without departing from the scope of this disclosure. Moreover, for ease of illustration, each user device 102 is described in terms of being used by one user. But this disclosure contemplates that many users may use one computer or that one user may use multiple computers to submit or review queries via GUI 110. As used in this disclosure, user device 102 is intended to encompass a personal computer, touch screen terminal, workstation, network computer, kiosk, wireless data port, wireless or wireline phone, personal data assistant (PDA), at least one processor within these or other devices, or any other suitable processing device. For example, user device 102 may comprise a computer that includes an input device, such as a keypad, touch screen, mouse, or other device that can accept information, and an output device that conveys information associated with the operation of network 106 or user devices 102, including digital data, visual information, or GUI 110. Both the input device and output device may include fixed or removable storage media such as a magnetic computer disk, CD-ROM, or other suitable media to both receive input from and provide output to users of clients 110 through the display, namely GUI 110.

GUI 110 comprises a graphical user interface operable to allow the user of user device 102 to interface with at least a portion of system 100 for any suitable purpose. Generally, GUI 110 provides the user of user device 102 with an efficient and user-friendly presentation of data provided by or communicated within system 100. GUI 110 may provide access to the front-end of a gaming application or virtual gaming surface 108*a* and 108*b* executing on user device 102. GUI 110 may comprise a plurality of customizable frames or views having interactive fields, pull-down lists, and buttons operated by the user. In some implementations, GUI 110 presents information associated with buttons and receives commands from the user of user device 102 via one of the input devices. Moreover, the term graphical user interface may be used in the singular or in the plural to describe at least one graphical user interface and each of the displays of a particular graphical user interface. Therefore, GUI 110 contemplates any graphical user interface, such as a generic web browser or touch screen, which processes information in system 100 and efficiently presents the results to the user. Network 106 can accept data from user device 102 via the web browser (e.g., Microsoft Internet Explorer or Mozilla Firefox) and return the appropriate HTML or XML responses using network 106. For example, the network 106 may receive a request 120 from user device 102 using the web browser and then execute the request 120 to store and/or retrieve information.

The enterprises 104*a* and 104*b* may comprise a corporate or business entity, a government body, a non-profit institution, or any other organization with the physical gaming surfaces 108*c* and 108*d*. The enterprises 104 may own, operate or otherwise manage the physical gaming surfaces 108. For example, the enterprise 104 may be a brick-and-mortar casino that operates the gaming surfaces 108. Of course, the enterprise 104 may also lease the gaming surfaces 108 or may hire contractors or agents who are responsible for maintaining, configuring, controlling, and/or managing the gaming surfaces 108. In some implementations, the enterprise 104 manages the gaming services accessed using the gaming surface 108. For example, the enterprise 104 may control the betting, odds and payouts associated with the gaming surface 108.

Network 106 facilitates wireless or wireline communication between computer server 102 and any other local or remote computer, such as clients 104. Indeed, while illustrated as single network 106, network 106 may be multiple networks without departing from the scope of this disclosure, so long as at least portion of network 106 may facilitate communications between senders and recipients of requests 120 and results. In other words, network 106 encompasses any internal and/or external network, networks, sub-network, or combination thereof operable to facilitate communications between various computing components in the system 100. Network 106 may communicate, for example, Internet Protocol (IP) packets, Frame Relay frames, Asynchronous Transfer Mode (ATM) cells, voice, video, data, and other suitable information between network addresses. Network 106 may include at least one local area network (LAN), radio access network (RAN), metropolitan area network (MAN), wide area networks (WAN), all or a portion of the global computer network known as the Internet, and/or any other communication system or systems at least one location.

In one aspect of operation, the user device 102*a* may receive a bet on the virtual gaming surface 108*a* and transmit, to the network 106, a notification 120 identifying the bet. For example, the user device 102*a* may receive a line bet between two areas assigned to a high probability and a low probability numbers and a bet on a multi-roll area. In addition, a player may bet on a multi-roll area using the physical gaming surface 108*c* at the enterprise 104*a*. In some implementations, the pots assigned to the gaming surfaces 108*a-d* can be combined such that a winning bet on either surface 108 wins the combined pot or splits the pot among all winning bets. In connection with rolling virtual dice, the user device 102*a* determines the winning bets, and, in connection with physical dice rolled on the gaming surface 108*c*, the enterprise 104*a* determines the winning bets. In the event that the multi-roll bets on both the surfaces 108*a* and 108*c* win within a certain period of time (e.g., 30 seconds, 1 minutes, 5 minutes), the different winning players may share the combined pots.

Figure 2:
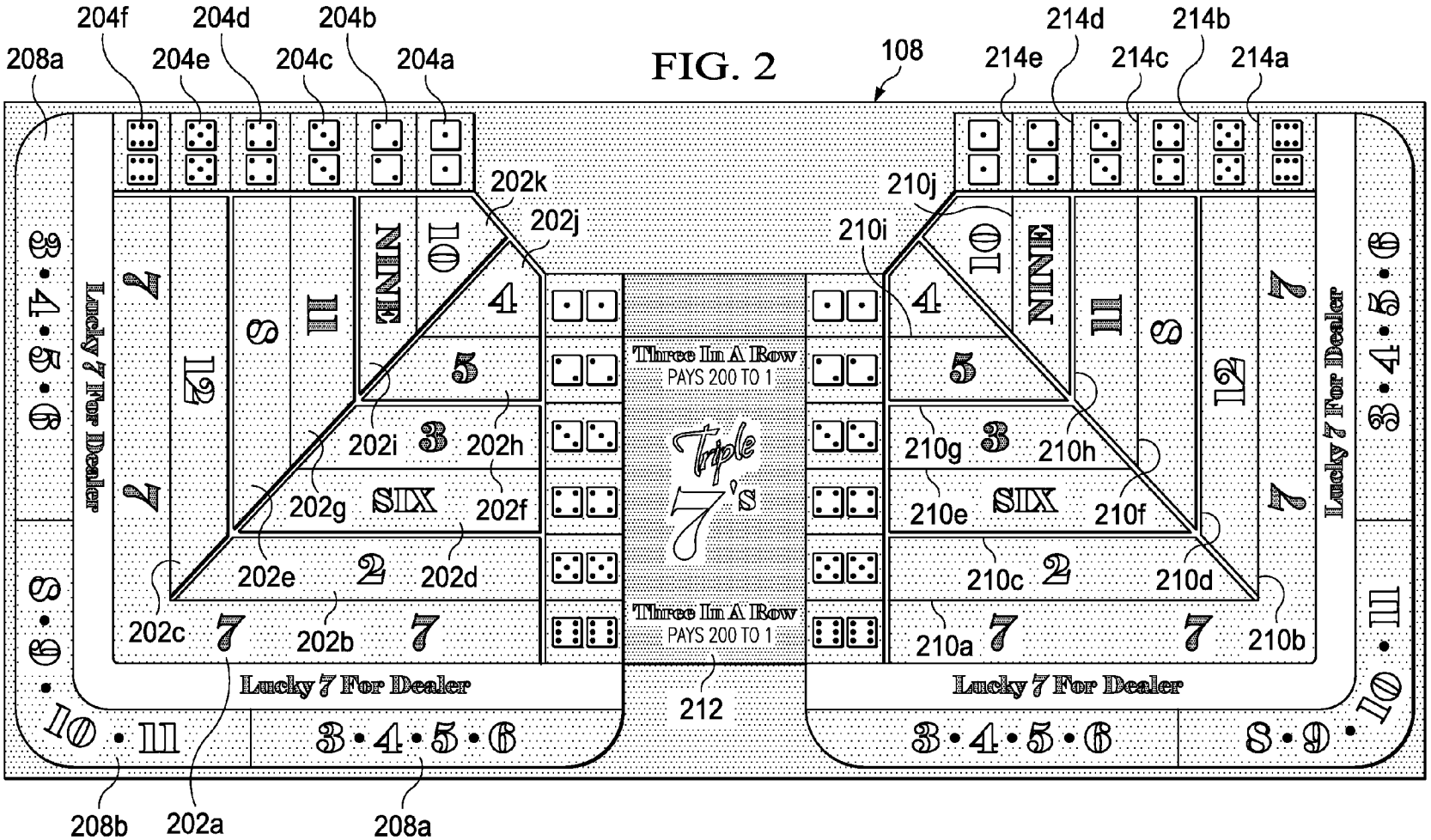
FIG. 2 is an example game surface.

FIG. 2 illustrates one example of a gaming surface 108 in accordance with some implementations of the present disclosure. In the illustrated implementation, the gaming surface 108 includes a plurality of different playing areas and line segments such that a subset of these elements are assigned to a possible outcome of a random number generator (e.g., pair six-sided dice). In the illustrated implementation, these elements may be assigned to at least one of the following bets: field bets on the numbers 2 thru 12; line bets on lines between numbers having different probabilities and/or the same probabilities; hard way bets on specific pairs; hard way line bets on lines between two hard way bets; range bets on ranges of numbers; and a bonus bet on a multi-roll outcome. As for field bets, the gaming surface 108 includes the areas 202*a-k* with each area 202 assigned to specific numbers 2 thru 12. In other words, the illustrated surface 108 includes number areas 202*a-k* assigned to possible numbers rolled by, for example, six-sided dice. Also, the probabilities for a subset of the areas 202 have different probabilities. In other words, some areas 102 are adjacent areas 102 with higher probabilities or lower probabilities. For example, the area 202*d* is adjacent areas 202*b* and 202*f* where each has a probability of occurrence lower than the area 202*d*.

In addition to having different probabilities, the areas 202*a-k* alternate between high probability numbers (e.g., 7, 8, 6, 9, 5) and low probability numbers (e.g., 12, 2, 11, 3, 10, 4). In other words, some areas 102 are between areas 102 with different higher probabilities or different lower probabilities. As illustrated, a subset of the areas 102 alternate between high and low probability numbers along a direction on the surface 108 such as the areas 202*a*, 202*c*, 202*e*, 202*g*, 202*k* or the areas 202*a*, 202*b*, 202*d*, 202*f*, 202*h*, and 202*j*. For example, the area 202*a*, which is assigned to seven and has the highest probability, is adjacent to area 202*b* and 202*c*, which is assigned to 2 and 12, respectively, and have the lowest probabilities. In addition, the area 202*b* may also be adjacent to the area 202*d*, which is assigned to six and has the second highest probabilities. In this instance, the area 202*b* is adjacent the areas 202*a* and 202*b* that have different probabilities higher than the probability of the area 202*b*. In the illustrated implementations, the areas 202 are aligned serially and alternate between higher and lower probabilities along a direction. By alternating between high and low probabilities, the players may be more likely to distribute bets across the gaming surface 108. The direction of the alternating areas 202 may be linear, circular, undulating, and/or other direction types without departing from the scope of this disclosure. In the illustrated example, the areas 202 having the same probabilities may also be adjacent such as area 202*b* and area 202*c*. Payouts for the field bets or areas 202*a-k* may vary according to the probability of occurrence of the number. For example, the areas 202 may be assigned the payouts for the following winning wagers: number 7 pays 4.5 times the wager, i.e., 9 to 2; numbers 6 and 8 pay 6 times the wager; numbers 5 and 9 pay 7.5 times the wager, i.e., 15 to 2; numbers 4 and 10 pay 10 times the wager; numbers 3 and 11 pay 16 times the wager; and numbers 2 and 12 pay 34 times the wager. The identified payouts are for illustration purposes only and the gaming surface 108 may have the same, some, or different payouts without departing from the scope of the disclosure.

Turning to line bets, at least a subset of the areas 202, 204, 206, 208, and 210 are separated by line segments 210 that offer bets on two different numbers having different probabilities of occurrence. For example, the line segments 210 may be located between 7 and 2, 2 and 6, 6 and 3, 3 and 5, 5 and 4, 7 and 12, 12 and 8, 8 and 11, 11 and 9, or 9 and 10 and pay, for example, 4 times the wager. By doing so, the line segments 210 enable betting options that cover multiple numbers or occurrences. For example, the area 202*a* assigned to the number seven and the area 202*b* assigned to the number two are separated by line segment 210*a*. Betting on the line segment 210*a* enables a user to bet on a seven or a two occurring from a single roll of the dice. In addition, the line segments 210 may include betting options for numbers with different probabilities (e.g., 2 and 7, 6 and 3, 4 and 5). For example, the surface 108 may enable a line bet at 210*e* such that the bet covers either a six or a three. In this example, this line bet would cover either the second highest probability roll or the second lowest probability roll. As discussed with respect to the field bets, the line segment 210 can be located between two adjacent areas 102 with one assigned to a high probability number (e.g., 7, 8, 6, 9, 5) and the other assigned to a low probability number (e.g., 12, 2, 11, 3, 10, 4). For example, the segment 210*a* is between the adjacent areas 202*a* and 202*b* where the areas 202*a* is assigned to a highest probability number and area 202*b* is assigned to a lowest probability number. At least a subset of the areas 202 are surrounded by a line segment (new number) that offers bets on a block of numbers. For example, the line segment may surround blocks of numbers such as 4, 5, 9 and 10. Betting on that line segment enables a user to bet on any of those numbers, 4, 5, 9 or 10 occurring from a single roll of the dice. Another line segment may enable a bet that 3, 6, 8, or 11 will occur, and yet another line segment may enable the bet that 2, 7, or 12 will.

Turning to other bets, the gaming surface 108 may include hard way bets placed for pairs of 1 thru 6 at areas 204*a-f*, hard way line bets on one of two different pairs occurring at lines 214*a-e*, range bets for a range of numbers—3 thru 6, and 8 thru 11 at areas 208*a* and 208*b*; and triple 7 bonus bet at area 212. As for hard way bets, the areas 204*a-f* offer bets on the dice resulting in two numbers that are the same, which is frequently referred to as a "hard" number such as a "hard 4" or "hard 8". As for payouts, a winning wager on hard way bet or areas 204*a-f* where the result is a hard 2, hard 4, hard 6, hard 8, hard 10 or hard 12 may pay 34 times the wager. As for the hard way line bets, the line segments 214*a-e* offers bets on two hard way bets or that the outcome will one of two adjacent hard numbers or areas 204. A winning wager on any hard way line bets may pay 16 times the wager. As for range bets, the areas 208*a* and 208*b* offer bets on ranges of numbers. The low range or area 208*a* includes any combination of the two dice resulting in the numbers 3 thru 6. The high range or area 208*b* includes any combination of the two dice resulting in the numbers 8 thru 11. A winning wager on either range bet or area 208 may pay 3 to 2. As for the multi-roll bets, the area 212 offers bets on that a seven will occur in three consecutive rolls. A winning wager may pay 200 to 1. In some implementations, the payout for the multi-roll bet may be based on a pot including at least a portion of previously-lost wagers in the area 212. In these instances, the area 212 may payout a larger amount than 200 and may be combined with areas 212 from different surfaces 108. The arrangement of the areas 202, 204, 206, 208, and 212 are for illustration purposes only, and the areas 202, 204, 206, 208, and 212 may be arranged differently and/or with different dimensions without departing from the scope of this disclosure.

In some aspects of operation, the gaming surface 108 may be controlled or otherwise managed by a banker, which may be an individual and/or a device. The number of players participating in the gaming surface 108 may not be limited. As previously mentioned, the gaming surface 108 includes displaying painted sections or areas 202, 204, 206, 208, and 212 corresponding to the possible outcomes of two six-sided dice, which are assigned odds paid. In some instances, a casino may determine the odds paid. The players may place their wagers on the 202, 204, 206, 208, and 212 to bet on any single number, a combination of numbers, ranges of numbers, even or odd numbers, or pairs. In some implementations, the rolling of the dice may be performed by the dealer, and may involve the use of a mechanical dice shaker. In other implementations, one player is frequently designated as the shooter and may be provided a pair of standard six-sided dice. The shooter may be changed in response to an event. This event may include a surface of one of the six-sided dice presenting an attribute (e.g., symbol, different color dot). The event may include other occurrences such as a third die, a number of turns, and/or others. Also, the gaming surface 108 may include areas that indicate that turn of the current shooter has ended and to pass the dice to the next player. Regardless, the current shooter passes the dice to the next player in response to the event. In connection with a single shooter progressing through multiple rolls, the gaming surface 108 may enable bets that progress through the same rolls and resolve the bets only after the shooter rolls a specified number such as through area 212. By rotating shooter, the game may promote player participation and involvement in the outcome of the game. After a period of time, the banker may call 'no more bets' to prevent bets being placed or removed. The shooter rolls the dice. The banker may call the resulting number from two standard six-sided dice. The banker collects all losing bets and pays the winning bets according to the payment odds assigned to the gaming surface 108. After all bets are paid, winnings may be cleared from the surface 108 and/or new bets may be placed. In response to an event as previously described, the outcome of that die may determine if the current shooter rolls again or whether the banker or current shooter passes the dice to the next player.

Figure 3:
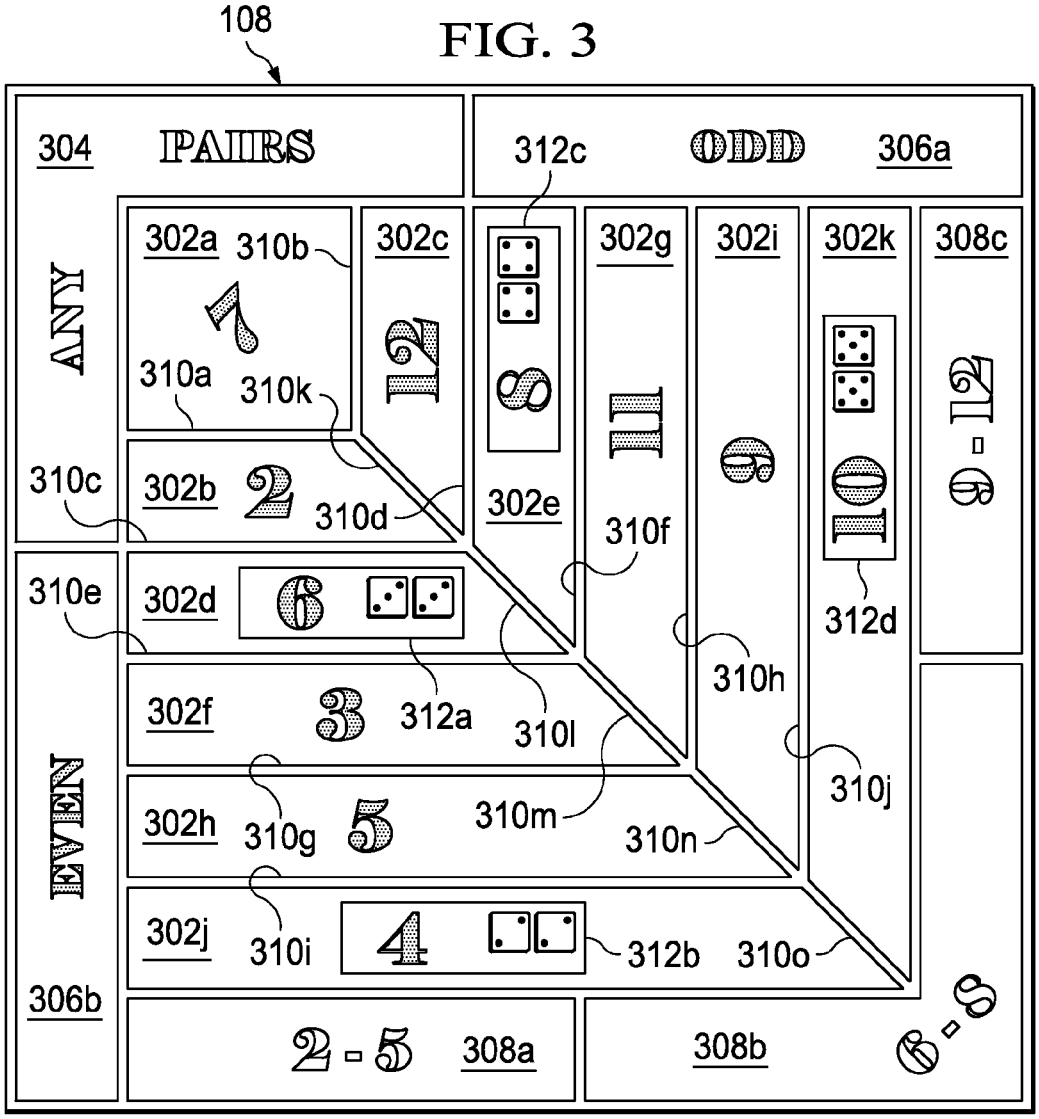
FIG. 3 is another example of a multi-player game surface.

FIG. 3 illustrates another gaming surface 108 with a plurality of different playing areas. Each area is assigned to a possible outcome of a random number generator such as a pair six-sided dice. The illustrated surface 108 includes number areas 302*a-k* assigned to possible numbers rolled, a pairs area 304 assigned to any pairs rolled, an odd area 306*a* assigned to odd numbers, an even area 306*b* assigned to even numbers, three range areas 308*a-c* and specific pairs 312*a-d*. The areas 302*a-k* may alternate between high and low probabilities. In the illustrated implementation, the area 302*a*, which is assigned to seven and has the highest probability, is adjacent to area 302*b* and 302*c*, which is assigned to 2 and 12, respectively, and have the lowest probabilities. In addition, the area 302*b* may also be adjacent to the area 302*d*, which is assigned to six and has the second highest probabilities. In some implementations, the areas 302 may be aligned serially and alternate between higher and lower probabilities along a single direction or a plurality of directions. By alternating between high and low probabilities, the players may be more likely to distribute bets across the playing surface 108. In the illustrated example, the areas 302 having the same probabilities may also be adjacent such as area 302*b* and area 302*c*. The arrangement of the areas 302 are for illustration purposes only, and the areas 302, 304, 306, and 308 may be arranged differently and/or with different dimensions without departing from the scope of this disclosure.

The areas 302, 304, 306, and 308 are separated by line segments 310. For example, the area 302*a* assigned to the number seven and the area 302*b* assigned to the number two are separated by line segment 310*a*. As previously mentioned, each area has an actual probability of being rolled or generated and assigned odds paid. In some implementations, the surface 108 may include different (e.g., lower) odds paid than actual odds to favor the managing enterprise. In addition to betting on individual numbers, the surface 108 may include betting options that cover multiple numbers or areas. For example, the surface 108 may include betting options that include two different numbers with the same probabilities (e.g., 2 and 12). In the illustrated example, the surface 108 may enable a diagonal line bet at 110*k* such that the bet covers either a two or a twelve. In this example, this diagonal line bet would cover multiple areas with the same probability roll. In addition, the surface 108 may include betting options that include two numbers with different probabilities (e.g., 2 and 7). In the illustrated example, the surface 108 may enable a line bet at 310*a* such that the bet covers either a seven or a two. In this example, this line bet would cover either the highest probability roll or the lowest probability roll. In some implementations, an area 302 may be located between and adjacent two other areas 302 such that both have either higher or lower probabilities. For example, the area 302*b* is between and adjacent the areas 302*a* and 302*d* where both the areas 302*a* and 302*b* have higher probabilities than area 302*b*. In addition in this example, the probabilities for the areas 302*a* and 302*b* have different probabilities. In another example, the area 302*d* is between and adjacent areas 302*b* and 302*f* where both have probabilities lower than the area 302*d*. In addition, the areas 302*b* and 302*f* have different probabilities. In the illustrated implementation, the areas 302 alternate between higher and lower probabilities along a line on the surface 108 such as a length. In some instances, the line may be linear, circular, and/or other types.

In some implementations, the surface 108 may include one or more of the following wagers: straight bets placed on any single number representing each possible combination of the dice ranging from 2 thru 12, inclusive; diagonal line bets placed on the diagonal line running between numbers that have the same probability of occurrence—such as 2 and 12, 6 and 8, 3 and 11, 5 and 9, and 4 and 10; line bets placed on the dividing line between adjacent numbers having a different probability of occurrence—such as 2 and 7, 2 and 6, 6 and 3, 3 and 5, 5 and 4, or 7 and 12, 12 and 8, 8 and 11, 11 and 9, 9 and 10; outside bets placed on the wagering areas for any even number 2 thru 12, inclusive; outside bets placed on the wagering areas for any odd number 3 thru 11, inclusive; outside bets placed on the wagering areas for any pair 2 thru 12, inclusive; hard way bets placed in the box located inside the wagering areas of a specific pair—4, 6, 8, and 10, respectively; range bets can be placed inside the wagering area of a range of numbers—2 thru 5, 6 thru 8, or 9 thru 12; and/or others In some aspects of operation, the surface 108 may be controlled or otherwise managed by a banker, which may be an individual and/or a device. The game may not limit the number of players participating in the playing surface 108. As previously mentioned, the playing surface 108 includes displaying painted sections or areas 102 corresponding to the possible outcomes of two six-sided dice, which are assigned odds paid. In some instances, a casino may determine the odds paid. The players may place their wagers on the playing surface 108 to bet on any single number, a combination of numbers, ranges of numbers, even or odd numbers, or pairs. One player is frequently designated as the shooter and may be provided a pair of standard six-sided dice. In some implementations, the shooter may be changed in response to an event. This event may include a surface of one of the six-sided dice presenting an attribute (e.g., symbol, different color dot). The event may include other occurrences such as a third die, a number of turns, and/or others. Also, the gaming surface 108 may areas that indicate that turn of the current shooter has ended and to pass the dice to the next player. Regardless, the current shooter passes the dice to the next player in response to the event. Also, the surface 108 may identify one or more areas 102, 104, 106, and/or 108 that indicates that turn of the current shooter has ended and to pass the dice to the next player. In connection with a single shooter progressing through multiple rolls, the surface 108 may enable bets that progress through the same rolls and resolve the bets only after the shooter rolls a specified number. By rotating shooter, the game may promote player participation and involvement in the outcome of the game. After a period of time, the banker may call 'no more bets' to prevent bets being placed or removed. The shooter rolls the dice. The banker may call the resulting number from two standard six-sided dice. The banker collects all losing bets and pays the winning bets according to the payment odds assigned to the playing surface 108. After all bets are paid, winnings may be cleared from the surface 108 and/or new bets may be placed. In response to an event as previously described, the outcome of that die may determine if the current shooter rolls again or whether the banker or current shooter passes the dice to the next player.

Figure 4:
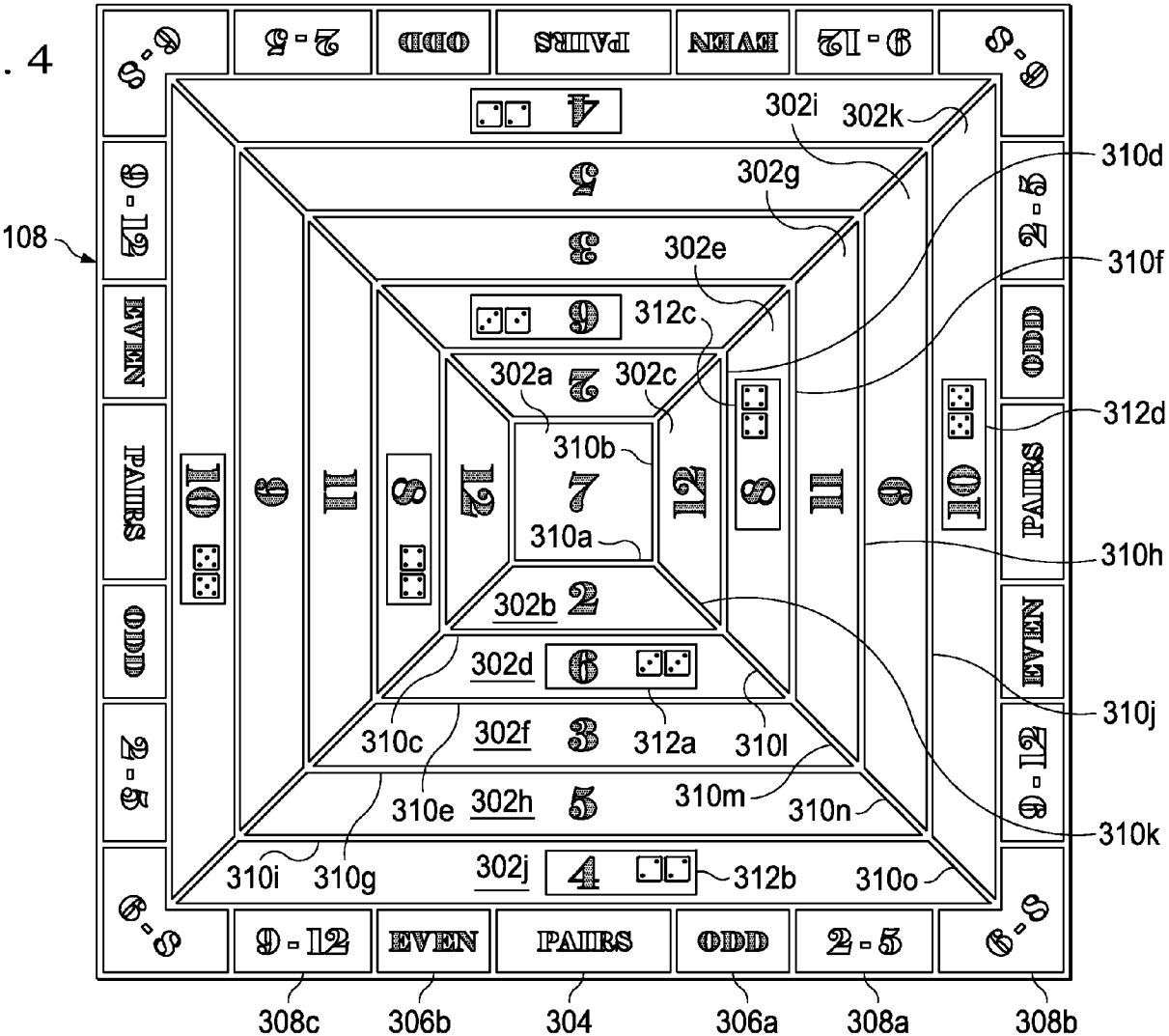
FIG. 4 is yet another example of a multi-player surface.

FIG. 4 illustrates yet another example gaming surface 108 that expands the surface 108 illustrated in FIG. 3. While the illustrated surface 108 may provide the same wagering as discussed with respect to FIG. 3, the surface 108 includes duplicate areas 102, 104, 106, and 108 with a different arrangement and configuration. In this case, the surface 108 may accommodate more players while providing substantially easy access to the different betting areas.

Figure 5:
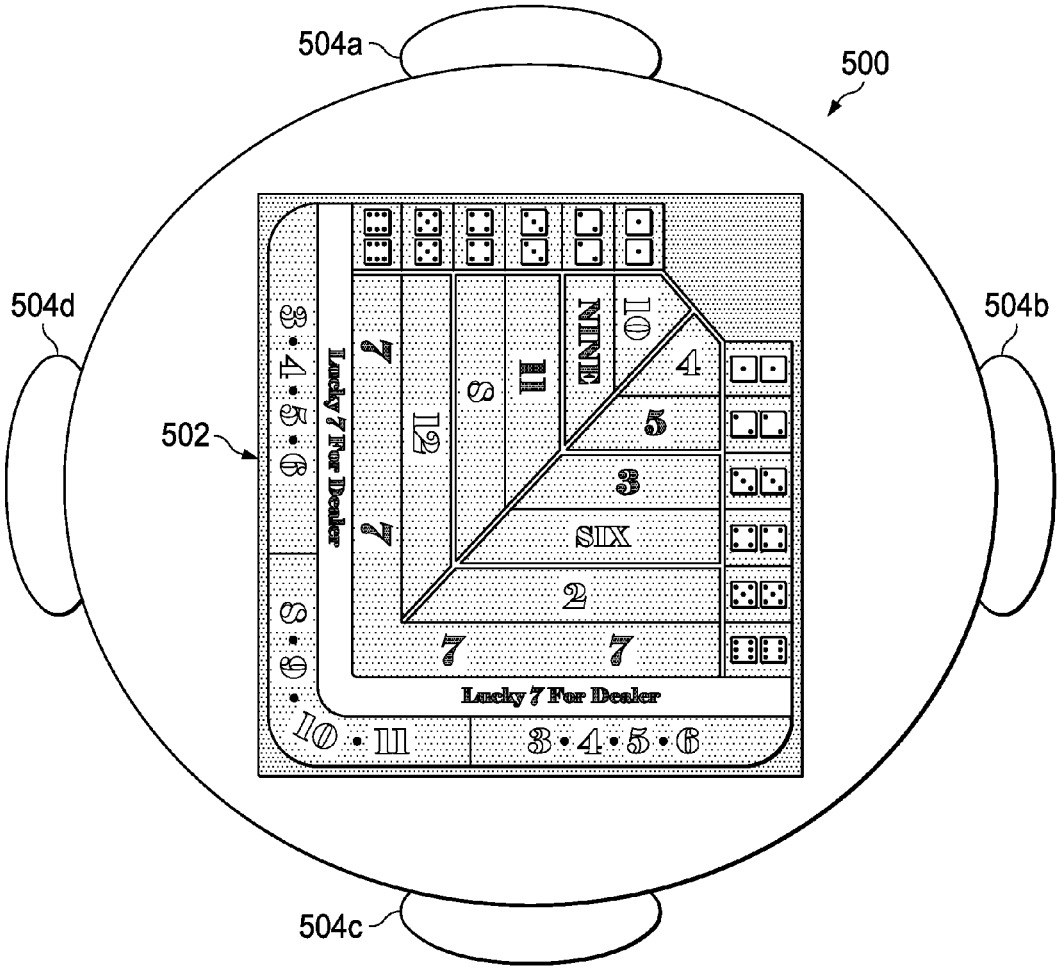
FIG. 5 illustrates an example board game in accordance with the present disclosure.

FIG. 5 illustrates yet another gaming system 500 for playing on a table top. In this implementation, the board 502 includes the same betting areas and possible wagers discussed with respect to FIG. 3. In addition, the board 502 may fold up to enable compact storage such as folding in half. Players may be positioned in the seats 504*a-d* and surround the board 502. While the board 502 includes the playing surface 108 illustrated in FIG. 3, the board 502 may include the playing surface 108 illustrated in FIG. 2 without departing from the scope of the disclosure.

FIG. 4 is a block diagram illustrating an electronic gaming system 600 that executes the wagering game previously discussed in a networked environment. In the illustrated implementation, the system 600 includes a network node 602 coupled to user devices 604*a-c* through a network 606. The network node 602 includes memory 608 and a processor 610. The memory 608 stores player profiles 612 for storing information associated with players. The processor 610 executes request engine 614 for managing game participation and a wager engine 616 for settling wagers after a random number generator generates a number. The user devices 604 include GUIs 618 for presenting and interacting with players. The GUI 618 may present interactive elements 620 for interacting with the request engine 614. In some implementations, the element 620 may present the surface 108 of FIG. 2 or 3 through the GUI 618.

As for a more detailed description, gaming network node 602 comprises an electronic computing device operable to receive, transmit, process and store data associated with system 600. System 600 can be implemented using computers other than servers, as well as a server pool. Indeed, gaming network node 402 may be any computer, electronic or processing device such as, for example, a blade server, general-purpose personal computer (PC), Macintosh, workstation, Unix-based computer, or any other suitable device. In other words, system 600 may include computers other than general purpose computers as well as computers without conventional operating systems. Gaming network node 602 may be adapted to execute any operating system including Linux, UNIX, Windows Server, or any other suitable operating system. In certain implementations, gaming network node 602 may also include or be communicably coupled with a web server and/or a mail server.

Gaming network node 602 includes memory 608 and a processor 610. Memory 608 may be a local memory and include any memory or database module and may take the form of volatile or non-volatile memory including, without limitation, magnetic media, optical media, random access memory (RAM), read-only memory (ROM), removable media, or any other suitable local or remote memory component. In the illustrated implementation, memory 608 includes player profiles 612, but may include other information without departing from the scope of this disclosure. Local memory 608 may also include any other appropriate data such as applications or services, firewall policies, a security or access log, print or other reporting files, HTML files or templates, data classes or object interfaces, child software applications or sub-systems, and others.

Player profiles 614 include one or more entries or data structures that include information associated with a player of a gaming service. For example, the player profile 612 may include a profile of a player, access information for an associated gaming service, information regarding a designated or authorized user device, and/or other information. In some implementations, a player profile 612 may include, indicate, or reference one or more of the following: a player ID, a driver license's number, a credit card number, service agreement, player history, player preferences, account number, home address, home phone number, user devices, hardware IDs, user ID, password, list of authorized devices, and/or any other suitable information associated with the player. In some implementations, each player profile 612 can be associated with a single individual, a single household, a single business, and/or other. In some implementations, the player profile 612 may include tracking information such as betting history, amount consumed (e.g., time, amount), executed games, date, time, account balances, user device ID, and/or other information. Player profiles 612 may be stored in any suitable format such as, for example, an XML document, a flat file, CSV file, a name-value pair file, SQL table, or others. Indeed, each profile 612 may be a temporary or a persistent data structure. Player profiles 612 may also be created, updated, or supplied by system 600, a third-party software vendor, or any appropriate user of any computer in system 600, loaded from a default profile, or received via network 606.

Figure 6:
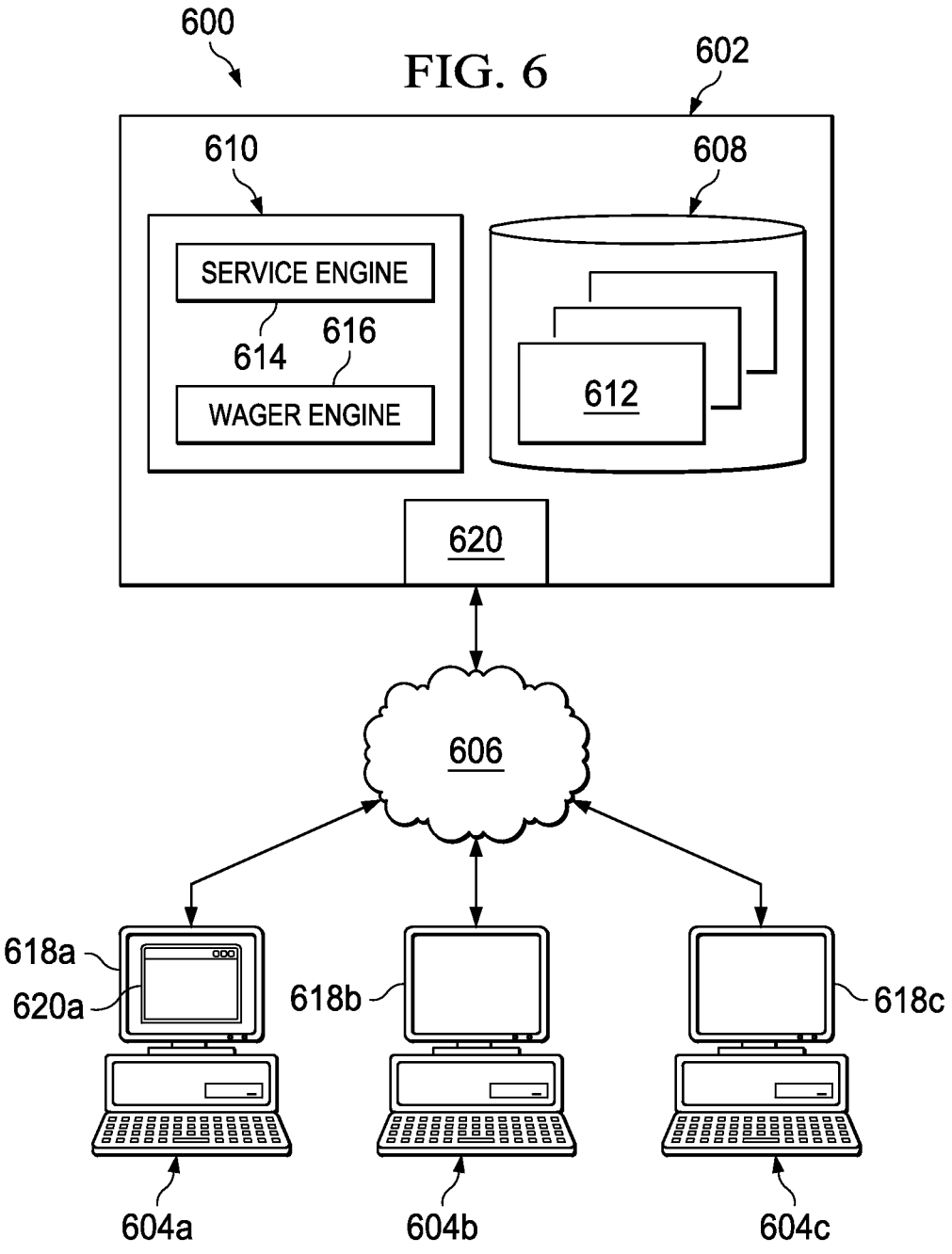
FIG. 6 illustrates an example system for managing wagers in a gaming system.

Processor 610 executes instructions and manipulates data to perform operations of gaming network node 602. Although FIG. 6 illustrates a single processor 610 in gaming network node 602, multiple processors 610 may be used according to particular needs, and reference to processor 610 is meant to include multiple processors 610 where applicable. In the illustrated implementation, processor 610 executes the service engine 614 and the wager engine 616. The service engine 614 includes any software, hardware, and/or firmware, or combination thereof, operable to manage gaming requests from user devices 604. For example, the service engine 614 may identify information for accessing games in the player profile 612 and transmit a request for access information to the requesting user device 604. In some implementations, the service engine 614 may execute one or more of the following: generate one or more player profiles 612 for a player in response to at least an initial registration; receive gaming request from authorized user devices 604; transmit a request for authentication information to the requesting user device 604; update games with players in response to at least authentication; manage wagers received from the user devices 604; and/or others. While the service engine 614 is illustrated and describe as both processing service requests and authentication, the system 600 may include additional modules that manage one or more aspects of these processes such as an authentication engine and/or location engine.

The wager engine 616 includes any software, hardware, and/or firmware, or combination thereof, operable to determine outcome of wagers placed by the user devices 604. For example, the wager engine 616 may determine payouts for winning wagers place on a virtual gaming surface as compared with randomly generated numbers. In some implementations, the wager engine 616 may execute one or more of the following: identify wagers placed on a virtual playing surface; identify an odds paid table in response to at least a wager matching a randomly generated number; determine a payout for the associated player based, at least in part, on the amount wagered and the odds paid; updating an account balance in the associated profile 612; and/or others.

Regardless of the particular implementation, "software," as used herein, may include software, firmware, wired or programmed hardware, or any combination thereof as appropriate. Indeed, request engine 614 and wager engine 616 may be written or described in any appropriate computer language including C, C++, C#, Java, J#, Visual Basic, assembler, Perl, any suitable version of 4GL, as well as others. It will be understood that while the request engine 614 and wager engine 616 are illustrated in FIG. 1 as including individual modules, each of the request engine 614 and wager engine 616 may include numerous other sub-modules or may instead be a single multi-tasked module that implements the various features and functionality through various objects, methods, or other processes. Further, while illustrated as internal to network node 602, one or more processes associated with the request engine 614 and/or wager engine 616 may be stored, referenced, or executed remotely. Moreover, the request engine 614 and wager engine 616 may be a child or sub-module of another software module or enterprise application (not illustrated) without departing from the scope of this disclosure.

Gaming network node 602 also includes interface 620 for communicating with other computer systems, such as clients 604, over network 606 in a client-server or other distributed environment. In certain implementations, gaming network node 602 receives data from internal or external senders through interface 620 for storage in local memory 608 and/or processing by processor 610. Generally, interface 620 comprises logic encoded in software and/or hardware in a suitable combination and operable to communicate with network 606. More specifically, interface 420 may comprise software supporting one or more communications protocols associated with communications network 406 or hardware operable to communicate physical signals.

Clients 604*a-c* are any devices (e.g., computing devices) operable to connect or communicate with the network node 602 and/or network 606 using any communication link. Each user device 604 includes, executes, or otherwise presents a GUI 618 and comprises an electronic device operable to receive, transmit, process and store any appropriate data associated with system 600. While the illustrated implementation includes clients 604*a-c*, system 600 may include any number of user devices 604 communicably coupled to the network node 602. Further, "user device 604" and "user" may be used interchangeably as appropriate. Moreover, for ease of illustration, each user device 604 is described in terms of being used by one user. But many users may use one device or that one user may use multiple devices.

As used in this disclosure, a user of user device 604 is any person, department, organization, small business, enterprise, or any other entity that may use or request others to use system 600. User device 604 is intended to encompass a personal computer, touch screen terminal, workstation, network computer, kiosk, wireless data port, smart phone, personal data assistant (PDA), a cellular phone, one or more processors within these or other devices, or any other suitable processing or electronic device used by a user viewing content from the network node 602. For example, the user device 604 may be a PDA operable to wirelessly connect with an external or unsecured network. In another example, the user device 604 may comprise a laptop that includes an input device, such as a keypad, touch screen, mouse, or other device that can accept information, and an output device that conveys information associated with content aggregated by the network node 602, including digital data, visual information, or GUI 618. Both the input device and output device may include fixed or removable storage media such as a magnetic computer disk, CD-ROM, or other suitable media to both receive input from and provide output to users of clients 604 through the display, namely the client portion of GUI 618.

The GUI 618 comprises a graphical user interface operable to allow the user of the user device 604 to interface with at least a portion of system 600 for any suitable purpose, such as presenting list views. Generally, the GUI 618 provides the particular user with an efficient and user-friendly presentation of data provided by or communicated within system 600. The GUI 618 may comprise a plurality of customizable frames or views having interactive fields, pull-down lists, and buttons operated by the user. For example, the GUI 618 may be operable to display a certain playing surface as illustrated in FIGS. 2 and 3. The GUI 618 can be configurable, supporting a combination of graphical elements (e.g., fields, buttons), to present the Web pages including the graphical elements 620. The term graphical user interface may be used in the singular or in the plural to describe one or more graphical user interfaces and each of the displays of a particular graphical user interface. The GUI 618 may be any graphical user interface, such as a generic web browser or touch screen that processes information in the system 600 and efficiently presents the results to the user. The network node 602 can accept data from the user device 604 via a web browser (e.g., Microsoft Internet Explorer or Netscape Navigator) and return the appropriate HTML, XML, and/or other responses to the browser using the network 606, such as the graphical elements 620.

Network 606 facilitates wireless or wired communication between gaming network node 602 and any other local or remote computer, such as user devices 604. For example, the network 606 may be a cable network, satellite network, and IPTV network, the Internet, an enterprise network, cellular network and/or other networks. In some implementations, the network 606 may be all or a portion of an enterprise or secured network. While illustrated as single network, network 606 may be a continuous network logically divided into various sub-nets or virtual networks without departing from the scope of this disclosure, so long as at least a portion of network 606 may facilitate communications of services between gaming network node 602 and user devices 604. In some implementations, network 606 encompasses any internal or external network, networks, sub-network, or combination thereof operable to facilitate communications between various computing components in system 600. Network 606 may communicate, for example, Internet Protocol (IP) packets, Frame Relay frames, Asynchronous Transfer Mode (ATM) cells, voice, video, data, and other suitable information between network addresses. Network 606 may include one or more local area networks (LANs), radio access networks (RANs), metropolitan area networks (MANs), wide area networks (WANs), all or a portion of the global computer network known as the Internet, and/or any other communication system or systems at one or more locations.

In one aspect of operation, the user device 604*a* transmits a request to join a game to the service engine 614. In response to at least the request, the service engine 614 identifies login information in the player profile 612 and associated information. After authentication, the service engine 614 enters the user device 604*a* in a selected game and presents a virtual playing surface to through the GUI 618*a*. In connection with the game, the player may interact with the element 620 such as entering wagers for a game. In response to a wager matching a randomly generated number, the wager engine determines odds paid and updates the account balance in the player profile 612 in accordance with the payout.

FIGS. 7A and 7B illustrates odds chart 700 and 720 in accordance with some implementations of the present disclosure. Referring to FIG. 7A, the chart 700 includes the following columns: category; bet; odds paid; and house edge. In some implementations, the odds chart 700 may be used in connection with the gaming surface 108 illustrated in FIG. 2. Referring to FIG. 7B, the chart 720 includes the following columns: category; bet; winning multiplier; actual odds; odds paid; and house edge. The example odds paid in charts 700 and 720 are for illustration purposes only and the odds paid may include some, none, or all of those depicted without departing from the scope of the disclosure. The odds are based on the range of possible outcomes of standard six-sided dice. The winnings multiplier is a variable that can be adjusted to modify the house edge on each bet, thereby affecting the overall house edge on the game.

Figure 8:
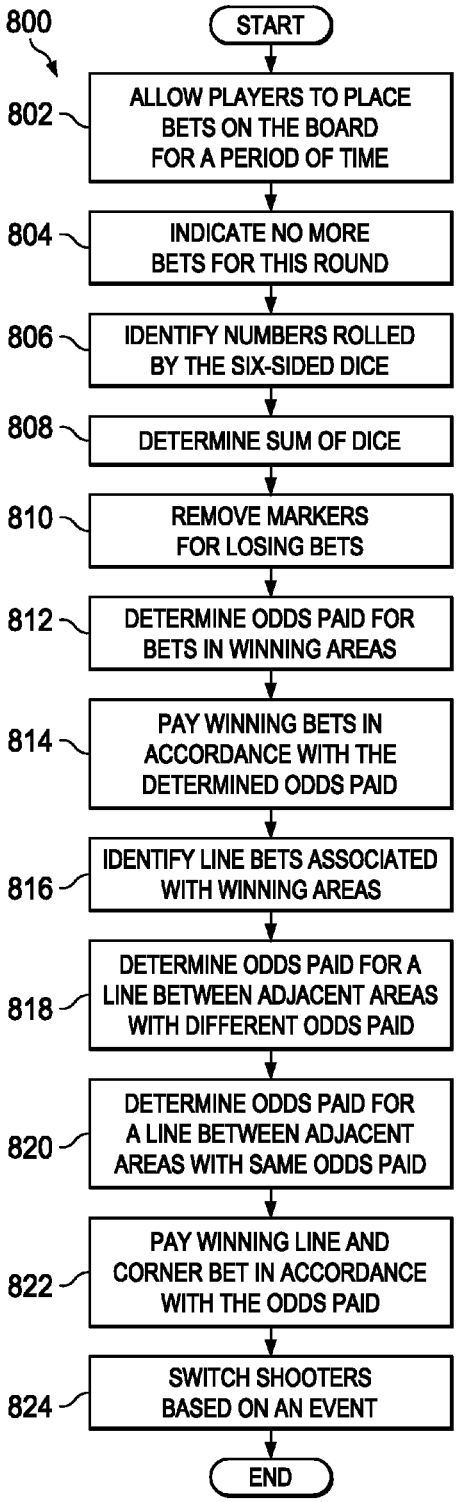
FIG. 8 is a flow chart illustrating an example method for managing wagers in a gaming system.
Figure 9:
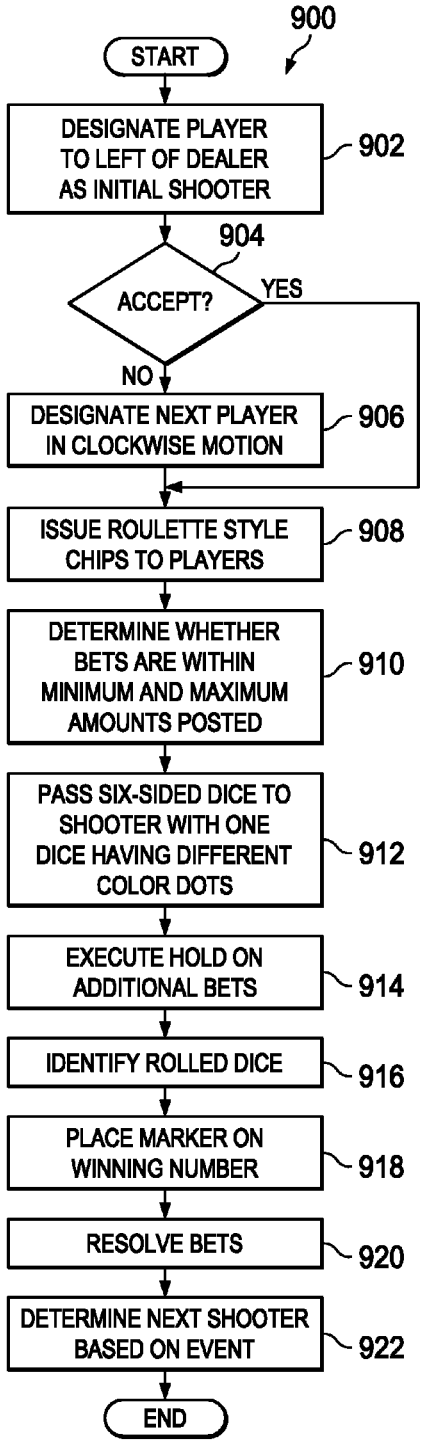
FIG. 9 is flow chart illustrating another example method for managing wagers in a gaming system.
Figure 10A:
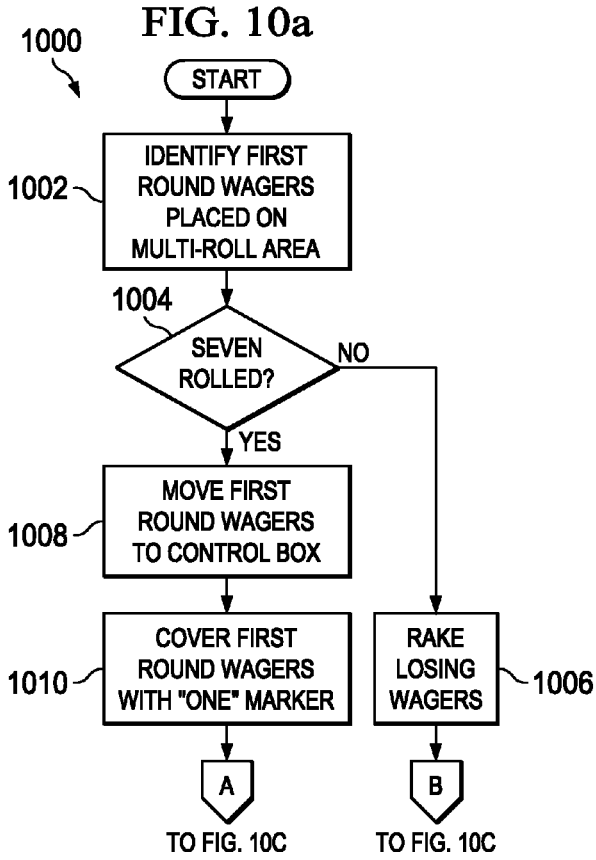
FIGS. 10A-C are flow charts illustrating another example method for managing wagers in a gaming system.
Figure 10B:
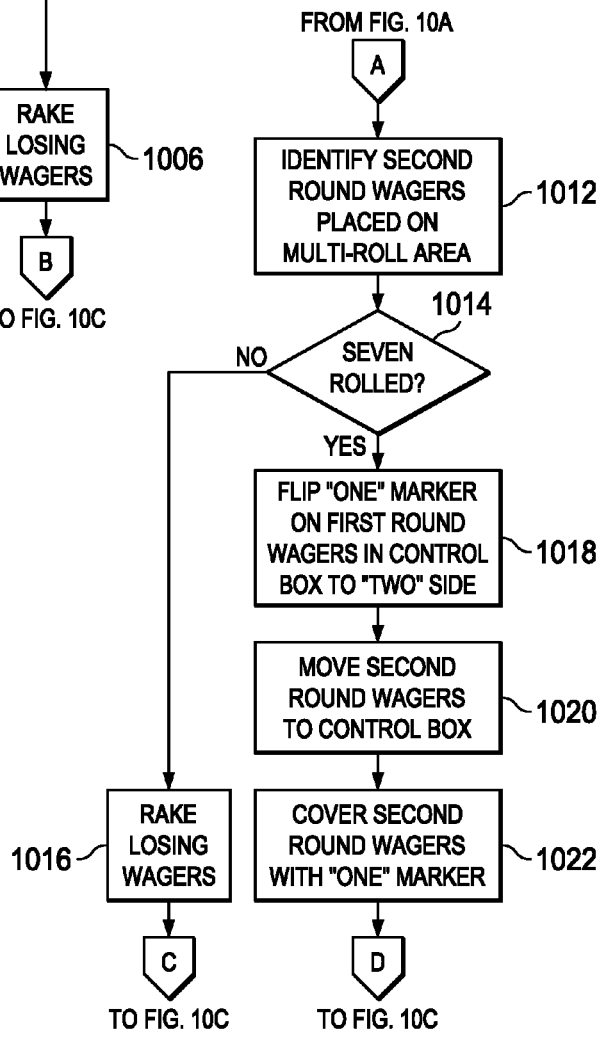
Figure 10C:
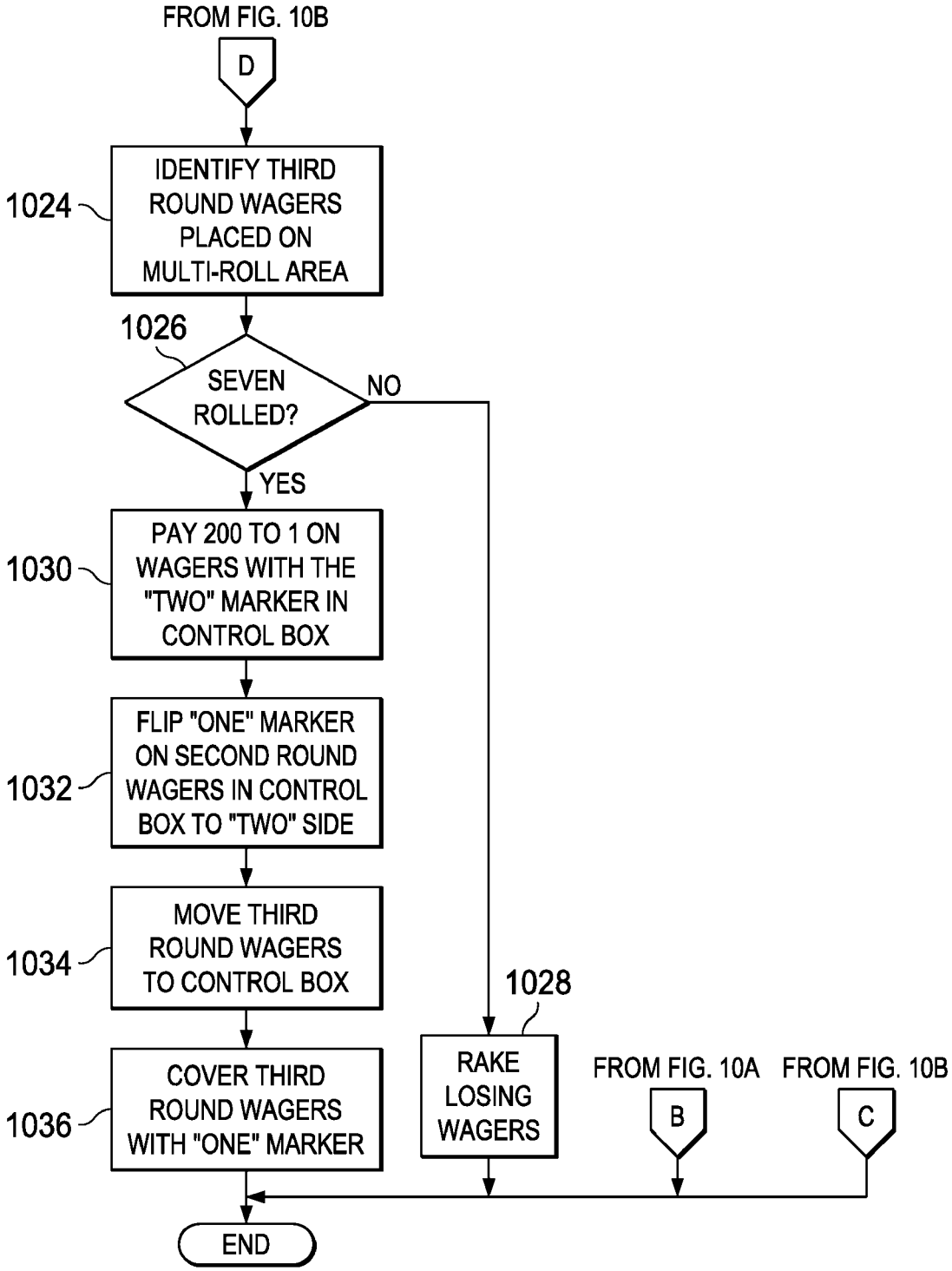

FIGS. 8-10 are flow charts illustrating an example method 800 and 900 for managing a gaming service in accordance with some implementations of the present disclosure. Generally, the methods 800, 900, and 1000 describe an example technique for determining wagers based on dice and odds paid. Methods 800, 900, and 1000 contemplate using any appropriate combination and arrangement of logical elements implementing some or all of the described functionality.

Referring to FIG. 8, the method 800 begins at step 802 where players are allowed to place bets on the board for a period of time. At step 804, the banker indicates that no more bets are allowed to be placed or removed for this round. Next, at step 806 and 808, the two numbers and their associated sum for a pair of six-sided dice are identified. Markers for losing bets are removed from the playing surface at step 810. At step 812, odds paid for bets in winning areas are determined. Next, at step 814, winning bets are paid in accordance with the determined odds paid. Inside line and diagonal line associated bets are identified at step 816. At steps 818, odds paid for a line bet between adjacent areas with different odds paid is determined. At step 820, odds paid for a line bet between adjacent areas with the same odds paid is determined. Next, at step 822, winning line bets are paid in accordance with the odds paid. The dice are passed from a current shooter to a new shooter in response to an event at step 824.

Referring to FIG. 9, the method 900 begins at step 902 where a player to the left of the dealer is designated as the initial shooter. In some implementations, the shooter must place a wager in order to roll the dice. If the player declines the dice at decisional step 904, the next player in a clockwise motion is designated at step 906. If the player accepts the dice, then, at step 908, roulette style chips are issued to the players. In some implementations, regular casino chips are issued to the players. The roulette-style chips may easily differentiate the wagers for each player. At step 910, the banker determines whether the bets are within minimum and maximum amounts posted. Next, at step 912, the six-sided dice are passed to the shooter with one die having different color dots. For example, the regular die may have white dots on all six sides, while the other die may have three sides with white dots and three sides with black dots. A hold on additional bets is executed at step 914. For example, dealer may announce "no more bets". At step 916, the rolled dice are identified, and, at step 918, the winning number is marked with a marker. If a winning wager is placed in the multi-roll area (e.g., triple seven bonus bet), then the dealer may place an additional marker in that area. The bets are resolved at step 920. At step 922, the next shooter is determined based on an event. For example, if a white dots face up, the shooter rolls the dice on the next round. If black dots face up, the dealer will designate the next player at the table as the shooter in a clockwise direction.

Referring to FIG. 10, method 1000 begins at step 1002 where new wagers on a multi-roll area are identified. For example, the multi-roll area may wager that three sevens will be consecutively rolled. If a seven is not rolled at decisional step 1004, then, at step 1006, the wagers are raked. If a seven is rolled, then, at step 1008, the first round wagers are moved to a control box. At step 1010, the moved wagers are covered or otherwise associated with a "One" marker. Next, at step 1012, wagers for a second round of players are identified. If a seven is not rolled at decisional step 1014, then, at step 1016, the wagers are raked. If a seven is rolled, then, at step 1018, the "One" marker is flipped to present a "Two" side. At step 1020, the second round wagers are moved to the control box. The second round wagers are covered with a "One" marker at step 1022. Next, at step 1024, wagers for third rounder of new players are identified. If a seven is not rolled at decisional step 1026, then, at step 1028, the wagers are raked. If a seven is rolled, then, at step 1030, a 200-to-1 payment is made on the wagers with the "Two" marker. The "One" marker on the second round wagers is flipped to the "Two" side at step 1032. The third round wagers are moved to the control box at step 1034. Next, at step 1036, the third round wagers are covered with a "One" marker.

In some implementations, a method and apparatus for playing a dice game, the method comprising designating one of the players as a shooter of a plurality of conventional six-sided die, wherein a single roll of the dice yields a possible combination of the numbers on the plurality of the die, placing one or more wagering markers on one or more betting areas that one of a plurality of events will occur, rolling a plurality of conventional six-sided die, and resolving the wager based on the roll of the plurality of the die. This method, wherein a single roll of the dice yields a possible combination of numbers two through twelve, inclusive, wherein the betting areas, designated by boundary lines, located on a playing surface of the game, have at least one representation of the possible combination, wherein the placing of the one or more of the markers further comprising wagering a straight bet by placing the marker within the boundary lines of the betting areas representing at least one of each possible combination of the single roll, wagering a diagonal line bet by placing the marker on at least one of the boundary lines between two of the betting areas that represent a plurality of each possible combination having a same probability of occurrence of the single roll, wherein the boundary lines are located at least between the betting areas representing numbers 2 and 12, between the betting areas representing numbers 3 and 11, between the betting areas representing numbers 4 and 10, between the betting areas representing numbers 5 and 9 and between the betting areas representing numbers 6 and 8, wagering a line bet by placing the marker on at least one of the boundary lines between two of the betting areas that represent a plurality of each possible combination having a different probability of occurrence of the single roll, wherein the boundary lines are located at least between the betting areas representing numbers 2 and 6, between the betting areas representing numbers 2 and 7, between the betting areas representing numbers 3 and 5, between the betting areas representing numbers 3 and 6, between the betting areas representing numbers 4 and 5, between the betting areas representing numbers 7 and 12, between the betting areas representing numbers 8 and 11, between the betting areas representing numbers 8 and 12, between the betting areas representing numbers 9 and 10 and between the betting areas representing numbers 9 and 11, wagering an outside bet by placing the marker within the boundary lines of the betting areas representing any of the possible combination of the single roll representing even numbers two through twelve, inclusive, wagering an outside bet by placing the marker within the boundary lines of the betting areas representing any of the possible combination of the single roll representing odd numbers three through eleven, inclusive, wagering an outside bet by placing the marker within the boundary lines of the betting areas representing any of the possible combination of the single roll representing the same number, one through six, inclusive, on an upper side of the plurality of the die, wagering a hard way bet by placing the marker within the boundary lines of the betting areas representing a specific possible combination of the single roll representing the same number, one, on an upper side of the plurality of the die, wagering a hard way bet by placing the marker within the boundary lines of the betting areas representing a specific possible combination of the single roll representing the same number, two, on an upper side of the plurality of the die, wagering a hard way bet by placing the marker within the boundary lines of the betting areas representing a specific possible combination of the single roll representing the same number, three, on an upper side of the plurality of the die, wagering a hard way bet by placing the marker within the boundary lines of the betting areas representing a specific possible combination of the single roll representing the same number, four, on an upper side of the plurality of the die, wagering a hard way bet by placing the marker within the boundary lines of the betting areas representing a specific possible combination of the single roll representing the same number, five, on an upper side of the plurality of the die, wagering a hard way bet by placing the marker within the boundary lines of the betting areas representing a specific possible combination of the single roll representing the same number, six, on an upper side of the plurality of the die, wagering a range bet by placing the marker within the boundary lines of the betting areas representing any of the possible combination of the single roll, wherein the betting areas are represented by at least, the numbers 2-5, the numbers 6-8, and the numbers 9-12, rolling the dice to obtain a resulting combination of the possible combination, and receiving at least one marker based on an amount of the markers that have been placed on the betting areas representing the resulting combination.

In some implementations, a method of moderating a dice wagering game, the method comprising, providing to each of the players, a unique set of wagering markers identifying each of the players, ensuring the placement of one or more of the markers on one or more of betting areas by the players prior to the shooter rolling the dice, wherein the betting areas, designated by boundary lines and located on a playing surface of the game, have at least one representation of the possible combination, wherein the placing of the one or more of the markers further comprises, allowing the players to make a straight bet by placing the marker within a boundary line of the betting areas representing one possible combination of the single roll, allowing the players to make a diagonal line bet by placing the marker on a boundary line between two of the betting areas that represent possible combinations having a same probability of occurrence of the single roll, wherein the boundary lines are located, between the betting areas representing numbers 2 and 12, between the betting areas representing numbers 3 and 11, between the betting areas representing numbers 4 and 10, between the betting areas representing numbers 5 and 9, between the betting areas representing numbers 6 and 8, allowing the players to make a line bet by placing the marker on a boundary line between two of the betting areas that represent possible combinations having a different probability of occurrence of the single roll, wherein the boundary lines are located, between the betting areas representing numbers 2 and 6, between the betting areas representing numbers 2 and 7, between the betting areas representing numbers 3 and 5, between the betting areas representing numbers 3 and 6, between the betting areas representing numbers 4 and 5, between the betting areas representing numbers 7 and 12, between the betting areas representing numbers 8 and 11, between the betting areas representing numbers 8 and 12, between the betting areas representing numbers 9 and 10, between the betting areas representing numbers 9 and 11, allowing the players to make an outside bet by placing the marker within a boundary line of the betting area representing any possible combination of the single roll representing even numbers two through twelve, inclusive, allowing the players to make an outside bet by placing the marker within a boundary line of the betting area representing any possible combination of the single roll representing odd numbers three through eleven, inclusive, allowing the players to make an outside bet by placing the marker within a boundary line of the betting area representing any possible combination of the single roll representing a same number, one through six, inclusive, on an upper side of each of the die, allowing the players to make a range bet by placing the marker within a boundary line of the betting area representing any possible combination of the single roll, wherein the betting areas are represented by the numbers 2-5, the numbers 6-8, and the numbers 9-12, allowing the players to remove one or more of the markers on one or more of the betting areas prior to the shooter rolling the dice, providing the dice to the shooter, allowing the shooter to roll the dice to obtain a resulting combination, removing the markers placed on the betting areas that do not represent the resulting combination, and providing at least one marker, based on an amount of the markers, to the players whose markers have been placed on the betting areas representing the resulting combination.

In some implementations, a method of moderating a dice wagering game, the method comprising providing to each of the players, a unique set of wagering markers identifying each of the players, designating one of the players as a shooter of two conventional six-sided die, wherein a single roll of the dice yields a possible combination of numbers two through twelve, inclusive, ensuring the placement of one or more of the markers on one or more of betting areas by the players prior to the shooter rolling the dice, wherein the betting areas, designated by boundary lines and located on a playing surface of the game, have at least one representation of the possible combination, wherein the placing of the one or more of the markers further comprises allowing the players to make a straight bet by placing the marker within a boundary line of the betting areas representing one possible combination of the single roll, allowing the players to make a diagonal line bet by placing the marker on a boundary line between two of the betting areas that represent possible combinations having a same probability of occurrence of the single roll, wherein the boundary lines are located between the betting areas representing numbers 2 and 12, between the betting areas representing numbers 3 and 11, between the betting areas representing numbers 4 and 10, between the betting areas representing numbers 5 and 9, between the betting areas representing numbers 6 and 8, allowing the players to make a line bet by placing the marker on a boundary line between two of the betting areas that represent possible combinations having a different probability of occurrence of the single roll, wherein the boundary lines are located, between the betting areas representing numbers 2 and 6, between the betting areas representing numbers 2 and 7, between the betting areas representing numbers 3 and 5, between the betting areas representing numbers 3 and 6, between the betting areas representing numbers 4 and 5, between the betting areas representing numbers 7 and 12, between the betting areas representing numbers 8 and 11, between the betting areas representing numbers 8 and 12, between the betting areas representing numbers 9 and 10, between the betting areas representing numbers 9 and 11, allowing the players to make an outside bet by placing the marker within a boundary line of the betting area representing any possible combination of the single roll representing even numbers two through twelve, inclusive, allowing the players to make an outside bet by placing the marker within a boundary line of the betting area representing any possible combination of the single roll representing odd numbers three through eleven, inclusive, allowing the players to make an outside bet by placing the marker within a boundary line of the betting area representing any possible combination of the single roll representing a same number, one through six, inclusive, on an upper side of each of the die, allowing the players to make a range bet by placing the marker within a boundary line of the betting area representing any possible combination of the single roll, wherein the betting areas are represented by the numbers 2-5, the numbers 6-8, and the numbers 9-12, allowing the players to remove one or more of the markers on one or more of the betting areas prior to the shooter rolling the dice, providing the dice to the shooter, allowing the shooter to roll the dice to obtain a resulting combination, removing the markers placed on the betting areas that do not represent the resulting combination, providing at least one marker, based on an amount of the markers, to the players whose markers have been placed on the betting areas representing the resulting combination, and if the resulting combination represents the same number, one through six, inclusive, on the upper side of each of the die and if the shooter has placed the marker within a boundary line of the betting areas representing the resulting combination, additionally rewarding, by the dealer, the players whose markers have been placed on the betting areas representing the resulting combination.

In some implementations, method of moderating a dice wagering game, the method comprising providing to each of the players, a unique set of wagering markers identifying each of the players, designating one of the players as a shooter of two conventional six-sided die, wherein a single roll of the dice yields a possible combination of numbers two through twelve, inclusive, ensuring the placement of one or more of the markers on one or more of betting areas by the players prior to the shooter rolling the dice, wherein the betting areas, designated by boundary lines and located on a playing surface of the game, have at least one representation of the possible combination, wherein the placing of the one or more of the markers further comprises allowing the players to make a straight bet by placing the marker within a boundary line of the betting areas representing one possible combination of the single roll, allowing the players to make a diagonal line bet by placing the marker on a boundary line between two of the betting areas that represent possible combinations having a same probability of occurrence of the single roll, wherein the boundary lines are located between the betting areas representing numbers 2 and 12, between the betting areas representing numbers 3 and 11, between the betting areas representing numbers 4 and 10, between the betting areas representing numbers 5 and 9, between the betting areas representing numbers 6 and 8, allowing the players to make a line bet by placing the marker on a boundary line between two of the betting areas that represent possible combinations having a different probability of occurrence of the single roll, wherein the boundary lines are located between the betting areas representing numbers 2 and 6, between the betting areas representing numbers 2 and 7, between the betting areas representing numbers 3 and 5, between the betting areas representing numbers 3 and 6, between the betting areas representing numbers 4 and 5, between the betting areas representing numbers 7 and 12, between the betting areas representing numbers 8 and 11, between the betting areas representing numbers 8 and 12, between the betting areas representing numbers 9 and 10, between the betting areas representing numbers 9 and 11, allowing the players to make an outside bet by placing the marker within a boundary line of the betting area representing any possible combination of the single roll representing even numbers two through twelve, inclusive, allowing the players to make an outside bet by placing the marker within a boundary line of the betting area representing any possible combination of the single roll representing odd numbers three through eleven, inclusive, allowing the players to make an outside bet by placing the marker within a boundary line of the betting area representing any possible combination of the single roll representing a same number, one through six, inclusive, on an upper side of each of the die, allowing the players to make a range bet by placing the marker within a boundary line of the betting area representing any possible combination of the single roll, wherein the betting areas are represented by the numbers 2-5, the numbers 6-8, and the numbers 9-12, allowing the players to remove one or more of the markers on one or more of the betting areas prior to the shooter rolling the dice, providing the dice to the shooter, allowing the shooter to roll the dice to obtain a resulting combination, removing the markers placed on the betting areas that do not represent the resulting combination, providing at least one marker, based on an amount of the markers, to the players whose markers have been placed on the betting areas representing the resulting combination, and if the resulting combination represents consecutive numbers, on the upper side of each of the die and if the shooter has placed the marker within a boundary line of the betting areas representing the resulting combination, additionally rewarding, by the dealer, the players whose markers have been placed on the betting areas representing the resulting combination.

In some implementations, a method of interacting between a dealer and at least one player playing a dice wagering game comprises obtaining a set of wagering markers from the dealer, wherein the set uniquely identifies the player, designating, by the dealer, the player as a shooter of two conventional six-sided die, wherein a single roll of the dice yields a possible combination of numbers two through twelve, inclusive, ensuring the placement of one or more of the markers on one or more of betting areas by the player prior to the shooter rolling the dice, wherein the betting areas, designated by boundary lines and located on a playing surface of the game, have at least one representation of the possible combination, wherein the placing of the one or more of the markers further comprises wagering, by the player, a straight bet by placing the marker within a boundary line of the betting areas representing one possible combination of the single roll, wagering, by the player, a diagonal line bet by placing the marker on a boundary line between two of the betting areas that represent possible combinations having a same probability of occurrence of the single roll, wherein the boundary lines are located between the betting areas representing numbers 2 and 12, between the betting areas representing numbers 3 and 11, between the betting areas representing numbers 4 and 10, between the betting areas representing numbers 5 and 9, between the betting areas representing numbers 6 and 8, wagering, by the player, a line bet by placing the marker on a boundary line between two of the betting areas that represent possible combinations having a different probability of occurrence of the single roll, wherein the boundary lines are located between the betting areas representing numbers 2 and 6, between the betting areas representing numbers 2 and 7, between the betting areas representing numbers 3 and 5, between the betting areas representing numbers 3 and 6, between the betting areas representing numbers 4 and 5, between the betting areas representing numbers 7 and 12, between the betting areas representing numbers 8 and 11, between the betting areas representing numbers 8 and 12, between the betting areas representing numbers 9 and 10, between the betting areas representing numbers 9 and 11, wagering, by the player, an outside bet by placing the marker within a boundary line of the betting area representing any possible combination of the single roll representing even numbers two through twelve, inclusive, wagering, by the player, an outside bet by placing the marker within a boundary line of the betting area representing any possible combination of the single roll representing odd numbers three through eleven, inclusive, wagering, by the player, an outside bet by placing the marker within a boundary line of the betting area representing any possible combination of the single roll representing a same number, one through six, inclusive, on an upper side of each of the die, wagering, by the player, a range bet by placing the marker within a boundary line of the betting area representing any possible combination of the single roll, wherein the betting areas are represented by the numbers 2-5, the numbers 6-8, and the numbers 9-12, allowing, by the dealer, the player to remove one or more of the markers on one or more of the betting areas prior to the shooter rolling the dice, providing the dice to the shooter, rolling the dice, by the shooter, to obtain a resulting combination, removing, by the dealer, the markers placed on the betting areas that do not represent the resulting combination, and providing at least one marker, based on an amount of the markers, to the player whose markers have been placed on the betting areas representing the resulting combination.

A number of embodiments of the invention have been described. For example, the game may be played using video, mechanical or electronic representation of the dice, wager and rolling of the dice. In addition, a specified number (e.g., 10) of previously rolled numbers may be presented to the user during play. Nevertheless, it will be understood that various modifications may be made without departing from the spirit and scope of the invention. Accordingly, other embodiments are within the scope of the following claims.

What is claimed is:

1. A multiplayer game, comprising:

a playing surface including a plurality of areas, each area assigned to a number, associated with a probability of rolling the assigned number using two six-side dice, and assigned odds paid for wagering on the one or more multi-faced dice rolling on the assigned number for a single roll, first area of the plurality of areas assigned to seven having a number having a highest probability of being rolled, a second area of the plurality of areas between the first area and a third area and assigned to two or twelve having the lowest probability of being rolled, the third area of the plurality of areas between the second area and a fourth area and assigned to eight or six having a second highest probability of being rolled, the fourth area of the plurality of areas between the third area and a fifth area and assigned to eleven or three having the second lowest probability of being rolled, the fifth area of the plurality of areas between the fourth area and a sixth area and assigned to nine or five having a third highest probability of being rolled, the sixth area of the plurality of areas assigned to ten or four having the third lowest probability of being rolled, the first area, the second area, the third area, the fourth area and the fifth area are positioned along a direction on the playing surface;

the two six-sided dice configured to generate random numbers;

a plurality of lines including a first line separating the first area and the second area, a second line separating the third area and the fourth area, and a third line separating the fifth area and the sixth area, the first line, the second line and the third line having a same probability of rolling one of two different numbers adjacent that line and assigned odds paid for wagering on the two six-sided dice rolling on one of two different numbers adjacent that line; and markers representing various monetary values for wagering by players participating in the game.

2. The multiplayer game of claim 1, at least one of the one or more multi-faced dice including an attribute on at least one surface indicating that a shooter pass the one or more multi-faced dice to a next player.

3. The multiplayer game of claim 1, further comprising additional areas assigned to at least one of one or more ranges of numbers, even numbers, odd numbers, or any pair of numbers.

4. The multiplayer game of claim 1, the playing surface and the multi-faced dice comprise graphical images presented through one or more Graphical User Interfaces (GUIs).

5. The multiplayer game of claim 1, the playing surface and the multi-faced dice comprise a board game.

6. The multiplayer game of claim 1, the same probability comprises 7/36.

7. The multiplayer game of claim 1, further comprising a single area assigned to a wager covering events that occur in multiple rolls.

8. A method of playing a dice game, comprising:

presenting, through a computing device, a playing surface having:

a playing surface including a plurality of areas, each area assigned to a number, associated with a probability of rolling the assigned number using two six-side dice, and assigned odds paid for wagering on the one or more multi-faced dice rolling on the assigned number for a single roll, first area of the plurality of areas assigned to seven having a number having a highest probability of being rolled, a second area of the plurality of areas between the first area and a third area and assigned to two or twelve having the lowest probability of being rolled, the third area of the plurality of areas between the second area and a fourth area and assigned to eight or six having a second highest probability of being rolled, the fourth area of the plurality of areas between the third area and a fifth area and assigned to eleven or three having the second lowest probability of being rolled, the fifth area of the plurality of areas between the fourth area and a sixth area and assigned to nine or five having a third highest probability of being rolled, the sixth area of the plurality of areas assigned to ten or four having the third lowest probability of being rolled, the first area, the second area, the third area, the fourth area and the fifth area are positioned along a direction on the playing surface, and a plurality of lines including a first line separating the first area and the second area, a second line separating the third area and the fourth area, and a third line separating the fifth area and the sixth area, the first line, the second line and the third line having a same probability of rolling one of two different numbers adjacent that line and assigned odds paid for wagering on the two six-sided dice rolling one of two different numbers adjacent that line;

receiving a plurality of wagers on a playing surface;

establishing a shooter of six-sided dice for the wagering players;

identifying numbers generated by the six-sided dice in response to the shooter rolling;

resolving wagers placed in areas of the board assigned to numbers based, at least in part, on a sum total of the rolled dice;

identifying one or more line wagers assigned to a probability that the six-sided dice will result in one of two numbers with different probabilities; and resolving the one or more line in response to at least a sum total matching at least one of the two numbers with the different probabilities.

9. The method of claim 8, further identifying one or more attributes of at least one of the multi-faced dice indicating that a shooter pass the multi-faced dice to a next player.

10. The method of claim 8, further comprising resolving wagers in an additional area assigned to at least one of one or more ranges of numbers, even numbers, odd numbers, or any pair of numbers.

11. The method of claim 8, further comprising presenting a virtual playing area through a client including the playing surface and the multi-faced dice.

12. The method of claim 8, the same probability comprises 7/36.

13. The method of claim 8, the playing surface further comprising a single area assigned to a wager covering events that occur in multiple rolls.

14. A multiplayer game, comprising:

a playing surface including a plurality of areas, each area assigned to a number, associated with a probability of rolling the assigned number using two six-sided dice, and assigned odds paid for wagering on the two six-sided dice rolling on the assigned number for a single roll, first area of the plurality of areas assigned to seven having a highest probability of being rolled adjacent a second area of the plurality of areas assigned to a two or twelve with each having the lowest probability of being rolled, a third area of the plurality of areas assigned to a six or eight with each having a second highest probability of being rolled between the second area and a fourth area of the plurality of areas assigned to a three or eleven with each having the second lowest probability of being rolled, a fifth area of the plurality of areas assigned to a nine or five with each having a third highest probability of being rolled between the fourth area and a sixth area of the plurality of areas assigned to a four or ten with each having the third lowest probability of being rolled, the first area, the second area, the third area, the fourth area and the fifth area are positioned along a direction on the playing surface;

the two six-sided dice configured to generate a random number in a range of two to twelve;

a plurality of lines including a first line separating the first area and the second area, a second line separating the third area and the fourth area, and a third line separating the fifth area and the sixth area, each of the first line, the second line and the third line having 7/36 probability of rolling one of two different numbers adjacent that line and assigned odds paid for wagering on occurrence of one of the two different numbers adjacent that line;

a single area assigned to a wager covering a seven occurring in three consecutive rolls of the six-sided dice; and markers representing various monetary values for wagering by players participating in the game.

* * * * *

UNITED STATES PATENT AND TRADEMARK OFFICE

CERTIFICATE OF CORRECTION

PATENT NO. : 8,613,449 B2
APPLICATION NO. : 13/013678
DATED : December 24, 2013
INVENTOR(S) : David Brodrick It is certified that error appears in the above-identified patent and that said Letters Patent is hereby corrected as shown below:

In the Claims:

In Column 21, In Line 64, In Claim 1, after “rolling” delete “on”.

In Column 23, In Line 25, In Claim 14, after “roll,” insert -- a --.

Signed and Sealed this
Fifteenth Day of April, 2014

Michelle K. Lee

Michelle K. Lee
*Deputy Director of the United States Patent and Trademark Office*